US010056034B2

(12) United States Patent
Zhu et al.

(10) Patent No.: US 10,056,034 B2
(45) Date of Patent: Aug. 21, 2018

(54) ORGANIC LIGHT-EMITTING PIXEL DRIVING CIRCUIT, DRIVING METHOD AND ORGANIC LIGHT-EMITTING DISPLAY DEVICE

(71) Applicant: SHANGHAI TIANMA AM-OLED CO., LTD., Shanghai (CN)

(72) Inventors: Renyuan Zhu, Shanghai (CN); Zeyuan Chen, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/619,510

(22) Filed: Jun. 11, 2017

(65) Prior Publication Data

US 2017/0278457 A1 Sep. 28, 2017

(30) Foreign Application Priority Data

Jan. 23, 2017 (CN) ..... 2017 1 0049550

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2310/0262* (2013.01); *G09G 2320/0233* (2013.01); *G09G 2320/045* (2013.01)

(58) Field of Classification Search
CPC ... G09G 2300/0819; G09G 2300/0842; G09G 2310/0262; G09G 2320/0233; G09G 2320/045; G09G 3/3233
See application file for complete search history.

(56) References Cited

U.S. PATENT DOCUMENTS

2012/0162275 A1* 6/2012 Park ..... H01L 27/3265 345/690

* cited by examiner

*Primary Examiner* — Afroza Chowdhury
(74) *Attorney, Agent, or Firm* — Alston & Bird LLP

(57) ABSTRACT

The present disclosure discloses an organic light-emitting pixel driving circuit, driving method and an organic light-emitting display panel. A driving transistor is to generate a driving current, a light-emitting element is to emit light; a first transistor is to transmit a first initialization voltage to the light-emitting element; a second transistor is to transmit a second initialization voltage to the driving transistor; a third transistor is to transmit a data signal voltage to the pixel driving circuit; a fourth transistor is to transmit a reference voltage to the driving circuit; a first capacitor is coupled in series between the output terminal of the third transistor and the driving transistor; a fifth transistor is to control the first capacitor; a sixth transistor is to control light emission of the light-emitting element; a second capacitor is to maintain the charge amount between the gate and source of the driving transistor.

24 Claims, 9 Drawing Sheets

ORGANIC LIGHT-EMITTING PIXEL DRIVING CIRCUIT, DRIVING METHOD AND ORGANIC LIGHT-EMITTING DISPLAY DEVICE

CROSS-REFERENCE TO RELATED APPLICATION

This application is related to and claims priority from Chinese Patent Application No. CN201710049550.6, filed on Jan. 23, 2017, entitled "Organic Light-Emitting Pixel Driving Circuit, Driving Method and Organic Light-Emitting Display Device," the entire disclosure of which is hereby incorporated by reference for all purposes.

TECHNICAL FIELD

The present disclosure relates to the technical field of display, and particularly to an organic light-emitting pixel driving circuit, a driving method and an organic light-emitting display panel.

BACKGROUND

An organic light-emitting display panel displays images by using organic light-emitting elements, and is extensively applied to various electronic apparatuses as having advantages such as quick response and lower power consumption.

Usually, a display panel of an organic light-emitting display device comprises a plurality of pixels arranged in a matrix, and each of these pixels comprises an organic light-emitting element. Therefore, a level of a working state of the organic light-emitting element directly affects uniformity and luminance thereof. The organic light-emitting element is an electrical current controlling component and is usually driven using electrical current generated by a thin film transistor in a saturated state. Due to limitations of a manufacturing process, particularly a driving transistor manufactured using low-temperature polycrystalline silicon technology exhibits undesirable uniformity and drift of a threshold voltage Vth, so different driving current is generated when the same gray-scale voltage is the input. Inconsistency of the driving current makes the working state of the organic light-emitting element unstable and causes poor uniformity of display luminance of the organic light-emitting panel.

SUMMARY

To solve the problem mentioned above, the present application provides an organic light-emitting pixel driving circuit, a driving method and an organic light-emitting display panel.

In a first aspect, embodiments of the present disclosure provide an organic light-emitting pixel driving circuit, comprising a driving transistor and a light-emitting element, the driving transistor being configured to generate a driving current enabling the light-emitting element to emit light, the light-emitting element being configured to emit light in response to the driving current; a first transistor configured to transmit a first initialization voltage on a first initialization signal line to the light-emitting element in response to a signal input to a gate of the first transistor; a second transistor configured to transmit a second initialization voltage to the driving transistor in response to a signal input to a gate of the second transistor; a third transistor configured to transmit a data signal voltage on a data signal line to the organic light-emitting pixel driving circuit in response to a signal input to a gate of the third transistor; a fourth transistor configured to transmit a reference voltage to the organic light-emitting pixel driving circuit in response to a signal input to a gate of the fourth transistor, an output terminal of the third transistor and an output terminal of the fourth transistor being connected with each other; a first capacitor coupled in series between the output terminal of the third transistor and the driving transistor; a fifth transistor disposed between the first capacitor and the driving transistor and configured to control the first capacitor to couple own charges of the first capacitor to the driving transistor in response to a signal input to a gate of the fifth transistor; a sixth transistor configured to control a light emission process of the light-emitting element in response to a signal input to a gate of the sixth transistor; and a second capacitor coupled in series between a gate and source of the driving transistor, and configured to maintain an amount of charges between the gate and source of the driving transistor.

In a second aspect, embodiments of the present disclosure provide a method of driving the organic light-emitting pixel driving circuit, comprising: an initialization phase in which the first transistor is turned on in response to the signal input to the gate of the first transistor and transmits the first initialization voltage to the light-emitting element, and the second transistor is turned on in response to the signal input to the gate of the second transistor, and transmits the second initialization voltage to the driving transistor, so as to complete initialization of the driving transistor and the light-emitting element; a threshold detecting phase in which the third transistor is turned on in response to the signal input to the gate of the third transistor and transmits the data signal voltage to the organic light-emitting pixel driving circuit, and the fifth transistor is turned on in response to the signal input to the gate of the fifth transistor, the driving transistor discharges, and a threshold voltage of the driving transistor is detected; a coupling phase in which the fourth transistor is turned on in response to the signal input to the gate of the fourth transistor and transmits the reference voltage to the organic light-emitting pixel driving circuit, and the fifth transistor is turned on in response to the signal input to the gate of the fifth transistor, and couples charges of the first capacitor to the driving transistor; and a light-emitting phase in which the sixth transistor is turned on in response to the signal input to the gate of the sixth transistor and transmits the first power supply voltage to the driving transistor, the driving transistor is turned on and generates the driving current, and the light-emitting element emits light in response to the driving current.

In a third aspect, embodiments of the present disclosure provide an organic light-emitting display panel comprising multiple rows of pixel units, each row of the pixel units comprising a plurality of the organic light-emitting pixel driving circuits.

According to the organic light-emitting pixel driving circuit, makes the driving current generated by the driving transistor uniform and stable and improves display uniformity of the organic light-emitting display panel by controlling the first driving transistor and second driving transistor to turn on, initializing the light-emitting element and driving transistor, controlling the fifth transistor to turn on, and detecting the threshold voltage of the driving transistor.

BRIEF DESCRIPTION OF THE DRAWINGS

Other features, objects, and advantages of the present application will become more apparent upon reading of the following detailed description of the non-limiting embodiments with reference to the accompanying drawings, in which.

DETAILED DESCRIPTION OF EMBODIMENTS

The present application will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the relevant invention are shown in the accompanying drawings.

It should also be noted that the embodiments in the present application and the features in the embodiments may be combined with each other on a non-conflict basis. The present application will be described below in detail with reference to the accompanying drawings and in combination with the embodiments.

Figure 1A:
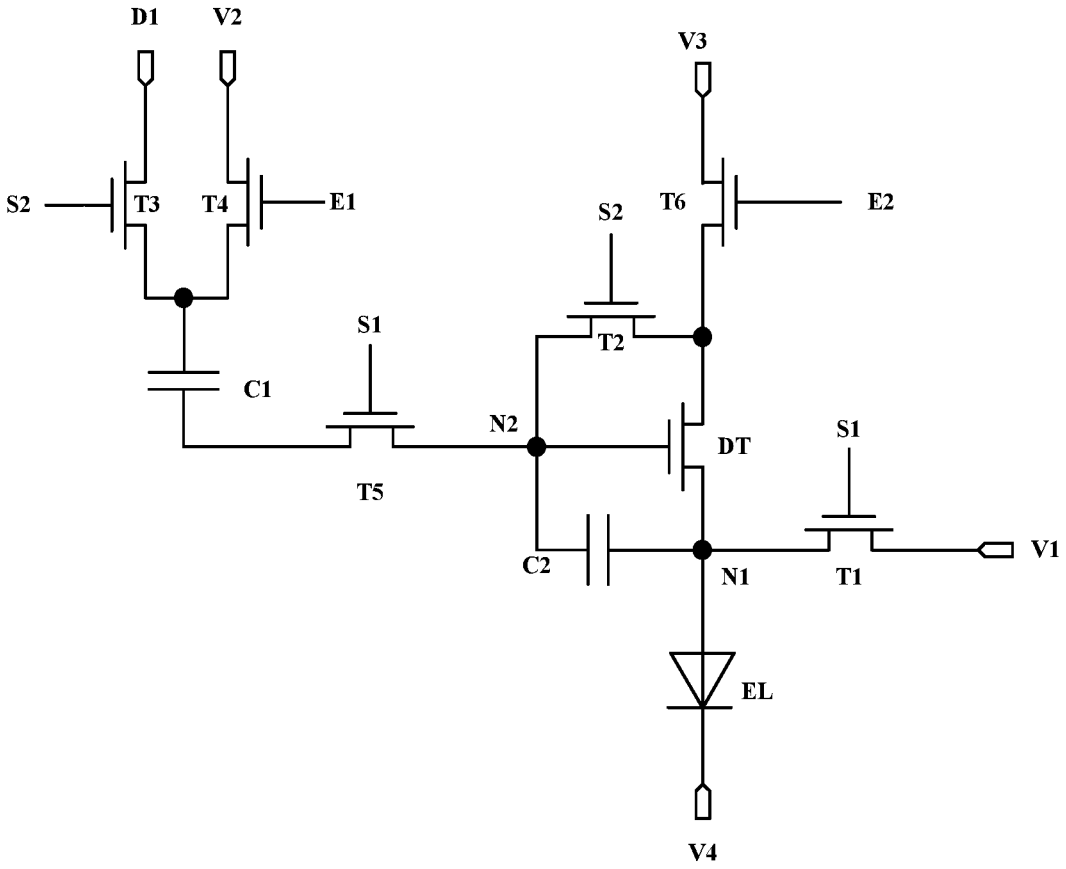
FIG. 1A illustrates a schematic diagram of an organic light-emitting pixel driving circuit according to an embodiment of the present disclosure.

Referring to FIG. 1A, it illustrates a schematic diagram of an organic light-emitting pixel driving circuit according to an embodiment of the present disclosure. As shown in the figure, the organic light-emitting pixel driving circuit in the present embodiment comprises a driving transistor DT, a light-emitting element EL, a first transistor T1, a second transistor T2, a third transistor T3, a fourth transistor T4, a fifth transistor T5, a sixth transistor T6, a first capacitor C1 and a second capacitor C2.

In the present embodiment, the organic light-emitting pixel driving circuit further comprises a first initialization signal line V1 and a data line D1. The driving transistor DT may generate a driving current enabling the light-emitting element EL to emit light so that the light-emitting element EL may emit light in response to the driving current. The first transistor T1 may transmit an initialization voltage on the first initialization signal line V1 to the light-emitting element EL in response to a signal input to a gate of the first transistor T1. The second transistor T2 transmits a second initialization voltage to the driving transistor DT in response to a signal input to a gate of the second transistor T2. The third transistor T3 may transmit a data signal voltage on the data line D1 to the organic light-emitting pixel driving circuit in response to the signal input to the gate of the third transistor T3. The fourth transistor T4 may transmit a reference voltage to the organic light-emitting pixel driving circuit in response to a signal input to a gate of the fourth transistor T4, wherein an output terminal of the third transistor T3 and an output terminal of the fourth transistor T4 may be electrically connected with each other.

In the present embodiment, the first capacitor C1 may be coupled in series between the output terminal of the third transistor T3 and the driving transistor DT. The fifth transistor T5 is electrically connected between the driving transistor DT and the first capacitor C1, and the fifth transistor T5 may control the first capacitor C1 to couple its own charge to the driving transistor DT in response to a signal input to the gate of the fifth transistor T5 to compensate a threshold voltage of the driving transistor DT. The sixth transistor T6 may control light emission of the light-emitting element EL in response to a signal input to a gate of the sixth transistor T6. The second capacitor C2 may be coupled in series between the gate and source of the driving transistor DT, and may maintain amount of charge between the gate and source of the driving transistor DT unchanged, as shown in FIG. 1A.

The organic light-emitting pixel driving circuit may further comprise a first power supply voltage signal line V3. As shown in FIG. 1A, the first power supply voltage signal line V3 may provide a first power supply voltage for the driving circuit. Furthermore, the second initialization voltage may be a first power supply voltage output by the first power supply voltage signal line V3. The first capacitor C1 may be specifically coupled in series between the output terminal of the third transistor T3 and the gate of the driving transistor DT. When the fifth transistor T5 is turned on in response to the signal input to the gate, a threshold voltage Vth of the driving transistor DT may be detected.

According to the organic light-emitting pixel driving circuit provided by the above embodiment, it is feasible to, by controlling the first transistor T1 and second transistor T5 to turn on, initialize the light-emitting element EL and the driving transistor DT, turn on the fifth transistor T5, make the potential of the gate or source of the driving transistor DT electrically connected with the fifth transistor T5 change, detect the threshold voltage Vth of the driving transistor DT, make the driving current generated by the driving transistor DT uniform and stable, and improve uniformity of display of the organic light-emitting display panel.

The organic light-emitting pixel driving circuit may further comprise a reference voltage line V2, a first scanning signal line S1, a second scanning signal line S2, a first light emission controlling signal line E1, a second light emission controlling signal line E2 and a second power supply voltage signal line V4. As shown in FIG. 1A, the reference voltage line V2 outputs the reference voltage. A first electrode of the first transistor T1 is electrically connected with the first initialization signal line V1, a second electrode of the first transistor T1 is electrically connected with an anode of the light-emitting element EL, and a gate of the first transistor T1 is electrically connected with the first scanning signal line S1. A first electrode of the second transistor T2 is electrically connected with a drain of the driving transistor DT, a second electrode of the second transistor T2 is electrically connected with the gate of the driving transistor DT, and a gate of the second transistor T2 is electrically connected with the second scanning signal line S2. A first electrode of the third transistor T3 is electrically connected with the data line D1, a second electrode of the third transistor T3 is electrically connected with a first electrode of the first capacitor C1, and a gate of the third transistor T3 is electrically connected with the second scanning signal line S2. A first electrode of the fourth transistor T4 is electrically connected with the reference voltage line V2, a second electrode of the fourth transistor T4 is electrically connected with the first electrode of the first capacitor C1, and a gate of the fourth transistor T4 is electrically connected with first light emission controlling signal line E1, wherein the second electrode of the third transistor T3 and second electrode of the fourth transistor T4 are respectively the output terminal of the third transistor T3 and output terminal of the fourth transistor T4. A first electrode of the fifth transistor T5 is electrically connected with the second electrode of the first capacitor C1, a second electrode of the fifth transistor T5 is electrically connected with the gate of the driving transistor DT, and a gate of the fifth transistor T5 is electrically connected with the first scanning signal line S1. A first electrode of the sixth transistor T6 is electrically connected with the first power supply voltage signal line V3, a second electrode of the sixth transistor T6 is electrically connected with a drain of the driving transistor DT, and a gate of the sixth transistor T6 is electrically connected with the second light emission controlling signal line E2. A first electrode of the second capacitor C2 is electrically connected with the gate of the driving transistor DT, a second electrode of the second capacitor C2 is electrically connected with the source of the driving transistor DT, an anode of the light-emitting element EL is electrically connected with the source of the driving transistor DT, and a cathode of the light-emitting element EL is electrically connected with the second power supply voltage signal line V4, as shown in FIG. 1A.

In some optional implementation modes of the present embodiment, the first transistor T1, second transistor T2, third transistor T3, fourth transistor T4, fifth transistor T5, sixth transistor T6 and the driving transistor DT each may be an NMOS transistor, as shown in FIG. 1A. It needs to be appreciated that FIG. 1A is only an exemplary driving circuit diagram. During practical applications, the transistors may be set to be an NMOS transistor or a PMOS transistor according to needs of application scenarios.

Figure 1B:
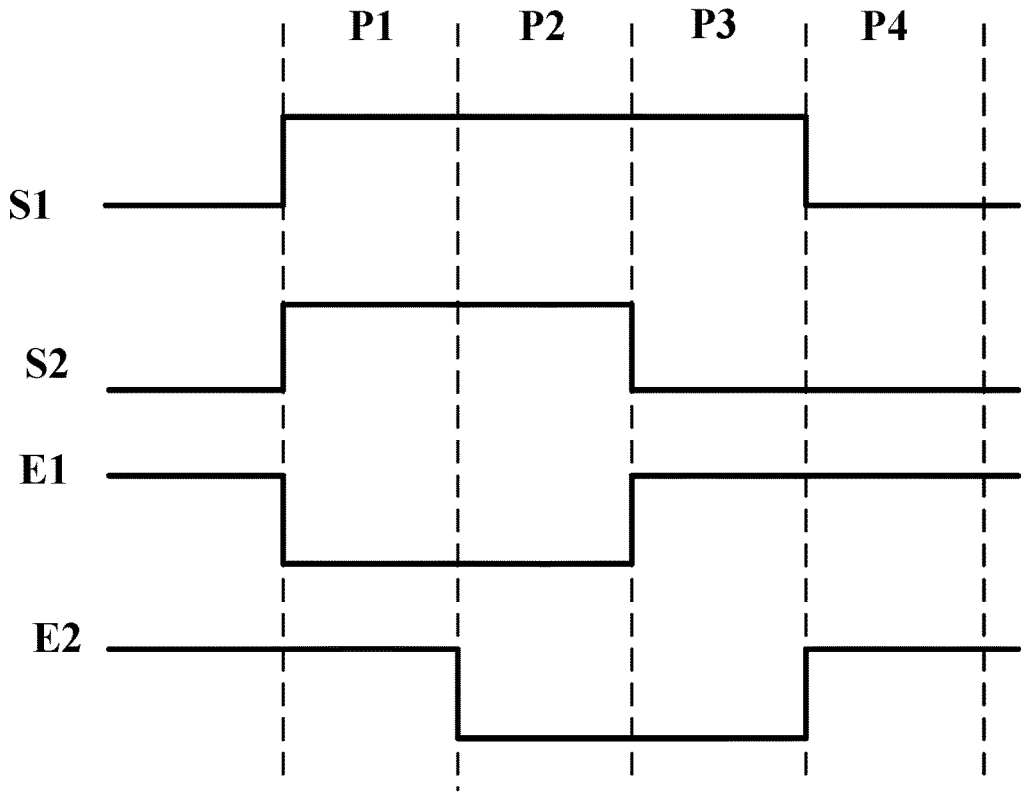
FIG. 1B illustrates a time sequence diagram of the organic light-emitting pixel driving circuit shown in FIG. 1A.

Hereunder, the working principle of the embodiment shown in FIG. 1A is described in conjunction with the time sequence diagram shown in FIG. 1B by taking an example in which the first transistor T1, second transistor T2, third transistor T3, fourth transistor T4, fifth transistor T5, sixth transistor T6 and the driving transistor DT each are an NMOS transistor.

In a first phase P1, a high level signal is applied to the first scanning signal line S1, the second scanning signal line S2 and the second light emission controlling signal line E2, a low level signal is applied to the first light emission controlling signal line E1, a data signal voltage Vdata is applied to the data signal line D1, and a first initialization voltage Vinit is output to the first initialization signal line V1. The first transistor T1, second transistor T2, third transistor T3, fifth transistor T5 and sixth transistor T6 are turned on. The first transistor T1 outputs the first initialization voltage Vinit on the first initialization signal line V1 to a node N1 (node N1 is an intersection point of the second electrode of the first transistor T1, the anode of the light-emitting element EL, the source of the driving transistor DT, and the second electrode of the second capacitor C2) so that the potential of the anode of the light-emitting element EL is the first initialization voltage Vinit and completes the initialization of the light-emitting element EL. The first power supply voltage PVDD on the first power supply voltage signal line V3 is output to a node N2 through the sixth transistor T6 and second transistor T2 (node N2 is an intersection point of the second electrode of the second transistor T2, the gate of the driving transistor DT, the first electrode of the capacitor C2 and the second electrode of the fifth transistor T5) so that the potential of the gate of the driving transistor DT is a first power supply voltage PVDD and completes the initialization of the driving transistor DT. In the first phase P1, the third transistor T3 is turned on, and the data signal voltage Vdata on the data line D1 is transmitted to the first capacitor C1.

Then, in a second phase P2, a high level signal is applied to the first scanning signal line S1 and the second scanning signal line S2, a low level signal is applied to the first light emission controlling signal line E1 and the second light emission controlling signal line E2, a data signal voltage Vdata is applied to the data signal line D1, and a first initialization voltage Vinit is output to the first initialization signal line V1. The first transistor T1, second transistor T2, third transistor T3 and fifth transistor T5 are turned on. The first initialization signal line V1 outputs the first initialization voltage Vinit to the node N1 so that the potential Vs of the source of the driving transistor DT is Vinit. And the data line D1 continues to write the data signal Vdata into the first capacitor C1 through the third transistor T3 so that the potential of the first electrode of the first capacitor C1 is Vdata, the driving transistor DT is turned on, the potential of node N2 changes from the first power supply voltage PVDD to Vinit+Vth, and the driving transistor DT is turned off. At this time, the potential Vg of the gate of the driving transistor DT is Vinit+Vth, the potential of the second electrode of the first capacitor C1 is also Vinit+Vth, so a voltage difference between two terminals of the first capacitor C1 is Vinit+Vth−Vdata. Here, Vth is a threshold voltage of the driving transistor DT. Furthermore, when the second phase P2 ends, the potential of the first electrode of the second capacitor C2 is Vinit+Vth, the potential of the second electrode of the second capacitor C2 is Vinit, and a voltage difference between two terminals of the second capacitor C2 is Vth.

In a third phase P3, a high level signal is applied to the first scanning signal line S1 and the first light emission controlling signal line E1, a low level signal is applied to the second scanning signal line S2 and the second light emission controlling signal line E2, a reference voltage Vref is applied to the reference voltage line V2, the first initialization voltage Vinit is applied to the first initialization signal line V1, and the first transistor T1, fourth transistor T4 and fifth transistor T5 are turned on. The first initialization signal line V1 outputs the first initialization voltage Vinit to the node N1, the potential of the second electrode of the second capacitor C2 is Vinit, and the reference voltage line V2 outputs the reference voltage Vref to the first electrode of the first capacitor C1. The fifth transistor T5 is turned on, and the second electrode of the first capacitor C1 and the first electrode of the second capacitor C2 have the same potential which may be set as X here. Hence, in the third phase P3, a total amount of stored charge of the first capacitor C1 and second capacitor C2 is (X−Vref)×C1+(X−Vinit)×C2. In the second phase P2 and third phase P3, since the total amount of stored charge of the first capacitor C1 and second capacitor C2 does not change, and the total amount of stored charge of the first capacitor C1 and second capacitor C2 is (Vinit+Vth−Vdata)×C1+Vth×C2 when the second phase P2 ends, the potential X is $$Vinit + Vth + \frac{C1}{C1 + C2}(Vref - Vdata)$$

in the third phase P3, namely, the potential of node N2 is $$Vinit + Vth + \frac{C1}{C1 + C2}(Vref - Vdata).$$

In a fourth phase P4, a high level signal is applied to the first light emission controlling signal line E1 and the second light emission controlling signal line E2, a low level signal is applied to the first scanning signal line S1 and the second scanning signal line S2, and a reference voltage Vref is applied to the reference voltage line V2. The fourth transistor T4 and sixth transistor T6 are turned on, the second power supply voltage signal line V4 outputs the second power supply voltage PVEE, the potential of the node N2 rises from $$Vinit + Vth + \frac{C1}{C1 + C2}(Vref - Vdata) \text{ to}$$

$$Vth + \frac{C1}{C1 + C2}(Vred - Vdata) + PVEE + Voled,$$

to and then the light-emitting element EL emits light. At this time, the voltage of the anode of the light-emitting element EL is PVEE+Voled, that is, the potential Vg of the gate of the driving transistor DT is $$Vinit + Vth + \frac{C1}{C1 + C2}(Vref - Vdata) + PVEE + Voled,$$

and the potential Vs of the source of the driving transistor DT is PVEE+Voled. Furthermore, the voltage difference between two terminals of the second capacitor C2 remains unchanged and is still $$Vth + \frac{C1}{C1 + C2}(Vref - Vdata).$$

Then, according to a formula of the light-emitting element generating the driving current, the driving current Ioled which flows through the driving transistor DT and is used to drive the light-emitting element EL to emit light will be in direct proportion to square of a differential value between a gate-source voltage Vgs (a voltage between the gate and source) of the driving transistor DT and its threshold voltage Vth. Therefore, the driving current of the light-emitting element $$Ioled \propto (Vgs - Vth)^2 = (Vg - Vs - Vth)^2 =$$

$$\left(\left(Vth + \frac{C1}{C1 + C2}(Vref - Vdata) + PVEE + Voled\right) - (PVEE + Voled) - Vth\right)^2$$

$$= \left(\frac{C1}{C1 + C2}(Vref - Vdata)\right)^2.$$

It can be seen that the driving current Ioled of the light-emitting element EL is irrelevant to the threshold voltage Vth of the driving transistor DT, and compensation for the threshold voltage of the driving transistor DT is implemented.

In some optional implementation modes of the present embodiment, the first initialization signal line V1 may be multiplexed as the reference voltage line V2, and the first initialization voltage Vinit output by the first initialization voltage V1 is the reference voltage. As such, the light-emitting display panel may not need the reference voltage line V2 and reduces an area of the layout occupied by the circuit in the organic light-emitting display panel.

In addition, pixel units in different rows in the light-emitting display panel are usually connected with the same first power supply voltage signal line V3. Since pixel units in different rows are at different distances from the first power supply voltage signal line V3, the problem of voltage attenuation exists when the first power supply voltage signal line V3 outputs the first power supply voltage PVDD to pixel units in different rows. In the present embodiment, the driving current Ioled of the light-emitting element EL is irrelevant to the first power supply voltage PVDD of the first power supply voltage signal line V3, thereby solving the problem of voltage attenuation when the first power supply voltage signal line V3 outputs the first power supply voltage to pixel units in different rows in the display panel, improving uniformity of the electrical current in a display region of the light-emitting display panel, and improving a display effect of the light-emitting display panel.

Therefore, when the organic light-emitting pixel driving circuit of the present embodiment is applied to the organic light-emitting display panel, since the light-emitting electrical current is irrelevant to the threshold voltage Vth of the driving transistor DT and the first power supply voltage PVDD of the first power supply voltage signal line V3, phenomena such as uneven display will not occur due to the threshold difference of the driving transistors and the voltage attenuation of the first power supply voltage signal line V3, and display uniformity of the light-emitting display panel is improved.

Figure 2A:
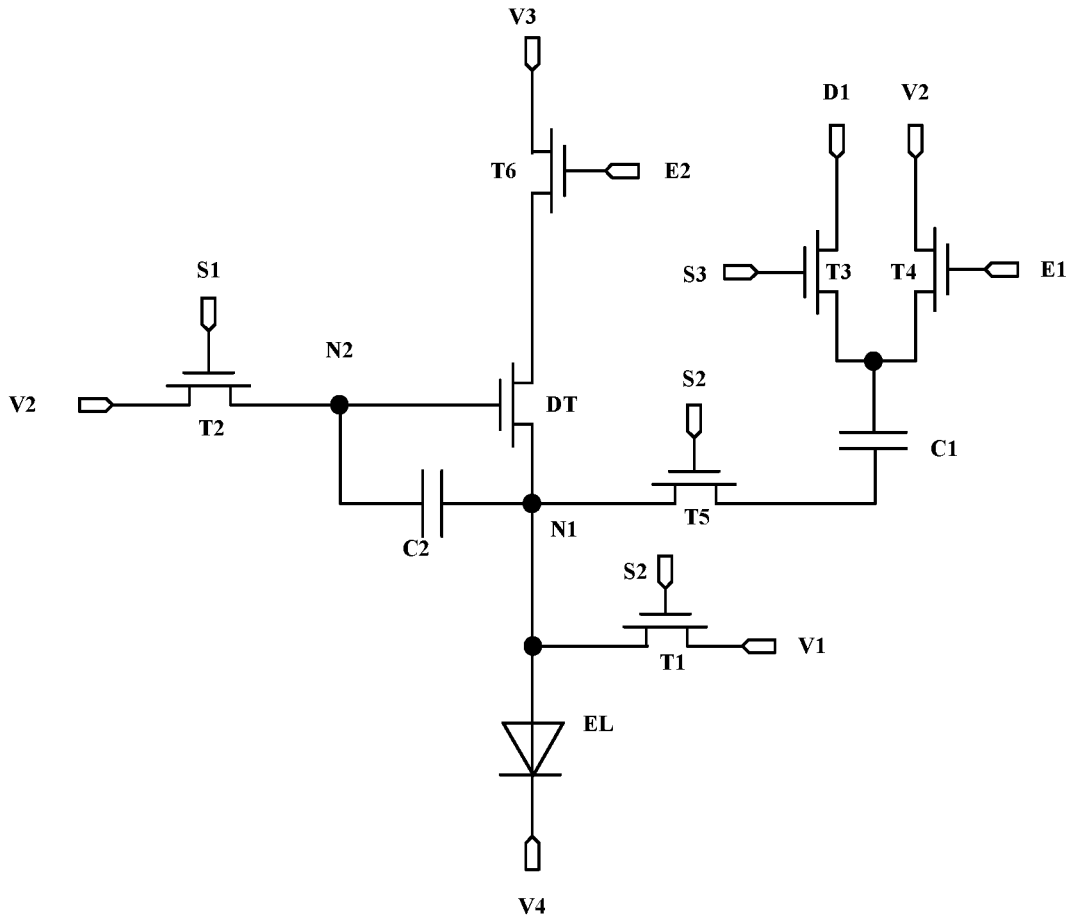
FIG. 2A illustrates a schematic diagram of an organic light-emitting pixel driving circuit according to another embodiment of the present disclosure.

Then, reference is made to FIG. 2A which illustrates a schematic structural diagram of another embodiment of an organic light-emitting pixel driving circuit according to the present disclosure.

Similar to the embodiment shown in FIG. 1A, the organic light-emitting pixel driving circuit in the present embodiment also comprises a driving transistor DT, a light-emitting element EL, a first transistor T1, a second transistor T2, a third transistor T3, a fourth transistor T4, a fifth transistor T5, a sixth transistor T6, a first capacitor C1 and a second capacitor C2, as shown in FIG. 2A.

In the present embodiment, the organic light-emitting pixel driving circuit further comprises a first initialization signal line V1 and a data line D1. The driving transistor DT may generate a driving current enabling the light-emitting element EL to emit light so that the light-emitting element EL may emit light in response to the driving current. The first transistor T1 may transmit an initialization voltage on the first initialization signal line V1 to the light-emitting element EL in response to a signal input to a gate of the first transistor T1. The second transistor T2 transmits a second initialization voltage to the driving transistor DT in response to a signal input to a gate of the second transistor T2. The third transistor T3 may transmit a data signal voltage on the data line D1 to the organic light-emitting pixel driving circuit in response to the signal input to the gate of the third transistor T3. The fourth transistor T4 may transmit a reference voltage to the organic light-emitting pixel driving circuit in response to a signal input to a gate of the fourth transistor T4, wherein an output terminal of the third transistor T3 and an output terminal of the fourth transistor T4 may be electrically connected with each other.

In the present embodiment, the first capacitor C1 may be coupled in series between the output terminal of the third transistor T3 and the driving transistor DT. The fifth transistor T5 is electrically connected between the driving transistor DT and the first capacitor C1, and the fifth transistor T5 may control the first capacitor C1 to couple its own charge to the driving transistor DT in response to a signal input to the gate of the fifth transistor T5. The sixth transistor T6 may control light emission of the light-emitting element EL in response to a signal input to a gate of the sixth transistor T6. The second capacitor C2 may be coupled in series between the gate and source of the driving transistor DT, and may maintain amount of charge between the gate and source of the driving transistor DT unchanged.

The organic light-emitting pixel driving circuit may further comprise a reference voltage line V2, a first scanning signal line S1, a second scanning signal line S2, a third scanning signal line S3, a first light emission controlling signal line E1, a second light emission controlling signal line E2 and a second power supply voltage signal line V4, as shown in FIG. 2A, wherein the reference voltage line V2 outputs the reference voltage. A first electrode of the first transistor T1 is electrically connected with the first initialization signal line V1, a second electrode of the first transistor T1 is electrically connected with an anode of the light-emitting element EL, and a gate of the first transistor T1 is electrically connected with the second scanning signal line S2. A first electrode of the second transistor T2 is electrically connected with the reference voltage line V2, a second electrode of the second transistor T2 is electrically connected with the gate of the driving transistor DT, and a gate of the second transistor T2 is electrically connected with the first scanning signal line S1. A first electrode of the third transistor T3 is electrically connected with the data line D1, a second electrode of the third transistor T3 is electrically connected with a first electrode of the first capacitor C1, and a gate of the third transistor T3 is electrically connected with the third scanning signal line S3. A first electrode of the fourth transistor T4 is electrically connected with the reference voltage line V2, a second electrode of the fourth transistor T4 is electrically connected with the first electrode of the first capacitor C1, and a gate of the fourth transistor T4 is electrically connected with first light emission controlling signal line E1. A first electrode of the fifth transistor T5 is electrically connected with the second electrode of the first capacitor C1, a second electrode of the fifth transistor T5 is electrically connected with the source of the driving transistor DT, and a gate of the fifth transistor T5 is electrically connected with the first scanning signal line S1. A first electrode of the sixth transistor T6 is electrically connected with the first power supply voltage signal line V3, a second electrode of the sixth transistor T6 is electrically connected with a drain of the driving transistor DT, and a gate of the sixth transistor T6 is electrically connected with the second light emission controlling signal line E2. A first electrode of the second capacitor C2 is electrically connected with the gate of the driving transistor DT, and a second electrode of the second capacitor C2 is electrically connected with the source of the driving transistor DT. An anode of the light-emitting element EL is electrically connected with the source of the driving transistor DT, and a cathode of the light-emitting element EL is electrically connected with the second power supply voltage signal line V4, as shown in FIG. 2A.

According to the organic light-emitting pixel driving circuit provided by the above embodiment, it is feasible to, by controlling the first transistor T1 and second transistor T5 to turn on, initialize the light-emitting element EL and the driving transistor DT, turn on the fifth transistor T5, make the potential of the source of the driving transistor DT electrically connected with the fifth transistor T5 change, detect the threshold voltage Vth of the driving transistor DT, make the driving current generated by the driving transistor DT uniform and stable, and improve uniformity of display of the organic light-emitting display panel.

Similar to FIG. 1A, the first transistor T1, second transistor T2, third transistor T3, fourth transistor T4, fifth transistor T5, sixth transistor T6 and the driving transistor DT each may be an NMOS transistor, as shown in FIG. 2A. Hereunder, the working principle of the embodiment shown in FIG. 2A is described in conjunction with the time sequence diagram shown in FIG. 2B.

In a first phase P1, a high level signal is applied to the first scanning signal line S1, the second scanning signal line S2, the first light emission controlling signal line E1 and the second light emission controlling signal line E2, a low level signal is applied to the third scanning signal line S3, a first initialization voltage Vinit is applied to the first initialization voltage signal line V1, and a reference voltage Vref is applied to the reference voltage line V2. The first transistor T1, second transistor T2, fourth transistor T4, fifth transistor T5 and sixth transistor T6 are turned on. The first transistor T1 outputs the first initialization voltage Vinit on the first initialization signal line V1 to a node N1 (node N1 is an intersection point of the second electrode of the first transistor T1, the anode of the light-emitting element EL, the source of the driving transistor DT, and the second electrode of the second capacitor C2) so that the potential of the anode of the light-emitting element EL is the first initialization voltage Vinit and completes the initialization of the light-emitting element EL. The second transistor T2 outputs the reference voltage Vref on the reference voltage line V2 to a node N2 (node N2 is an intersection point of the second electrode of the second transistor T2, the first electrode of the capacitor C2 and the gate of the driving transistor DT) so that the potential of the gate of the driving transistor DT is the reference voltage Vref and completes the initialization of the driving transistor DT. Meanwhile, the fourth transistor T4 outputs the reference voltage Vref on the reference voltage line V2 to the first electrode of the first capacitor C1.

In a second phase P2, a high level signal is applied to the first scanning signal line S1, the third scanning signal line S3 and the second light emission controlling signal line E2, a low level signal is applied to the second scanning signal line S2 and the first light emission controlling signal line E1, a data signal voltage Vdata is applied to the data line D1, and the reference voltage Vref is applied to the reference voltage line V2. The second transistor T2, third transistor T3, fifth transistor T5 and sixth transistor T6 are turned on so that the reference voltage line V2 may output the reference voltage Vref to node N2 through the second transistor T2, and the potential Vg of the gate of the driving transistor DT is Vref. And the data line D1 continues to write the data signal voltage Vdata into the first capacitor C1 through the third transistor T3, the potential of the first electrode of the first capacitor C1 is Vdata, the driving transistor DT is turned on, the potential of node N1 falls from Vinit to Vref-Vth, the driving transistor DT is turned off, whereupon the potential Vg of the gate of the driving transistor DT is Vref-Vth. The potential of the second electrode of the first capacitor C1 is also Vref-Vth, and a voltage difference between two terminals of the first capacitor C1 is Vdata-Vref+Vth. When the second phase P2 ends, both electrodes of the second capacitor C2 are respectively node N1 and node N2, so the potential difference of both terminals of the second capacitor C2 is Vth.

In a third phase P3, a high level signal is applied to the first scanning signal line S1 and the first light emission controlling signal line E1, a low level signal is applied to the second scanning signal line S2, the third scanning signal line S3 and the second light emission controlling signal line E2, and a reference voltage Vref is applied to the reference voltage line V2. The second transistor T2, fourth transistor T4 and fifth transistor T5 are turned on. The reference voltage line V2 outputs the reference voltage Vref to the first electrode of the first capacitor C1 through the fourth transistor T4, and the reference voltage line V2 outputs the reference voltage Vref to the node N2 through the second transistor T2. The fifth transistor T5 is turned on, and the second electrode of the first capacitor C1 and the first electrode of the second capacitor C2 have the same potential which may be set as Y here. Hence, in the third phase P3, a total amount of charge of the first capacitor C1 and second capacitor C2 is (Vref−Y)×C2+(Vref−Y)×C1. In the second phase P2 and third phase P3, since the total amount of charge of the first capacitor C1 and second capacitor C2 does not change, and the total amount of charge of the first capacitor C1 and second capacitor C2 is (Vdata−Vref+Vth)×C1+Vth×C2 when the second phase P2 ends, the potential Y is $$Vref - Vth + \frac{C1}{C1 + C2}(Vref - Vdata)$$

in the third phase P3, namely, the potential of node N1 is $$Vref - Vth + \frac{C1}{C1 + C2}(Vref - Vdata).$$

In a fourth phase P4, a high level signal is applied to the first light emission controlling signal line E1 and the second light emission controlling signal line E2, a low level signal is applied to the first scanning signal line S1, the second scanning signal line S2 and the third scanning signal line S3, and a reference voltage Vref is applied to the reference voltage line V2. The fourth transistor T4 and sixth transistor T6 are turned on, the second power supply voltage signal line V4 outputs the second power supply voltage PVEE, the first power supply voltage signal line V3 provides the first power supply voltage to the driving transistor DT through the sixth transistor T6, the potential of the node N1 rises from $$Vref - Vth + \frac{C1}{C1 + C2}(Vref - Vdata)$$

to PVEE+Voled, i.e., the voltage Vs of the source of the driving transistor DT is PVDD+Voled, and the light-emitting element EL emits light. At this time, the voltage difference between two terminals of the second capacitor C2 remains unchanged, and potential Vg of the gate of the driving transistor is $$Vth + \frac{C1}{C1 + C2}(Vdata - Vref) + PVEE + Voled.$$

Then, according to a formula of the light-emitting element generating the driving current, the driving current Ioled which flows through the driving transistor DT and is used to drive the light-emitting element EL to emit light will be in direct proportion to square of a differential value between a gate-source voltage Vgs (a voltage between the gate and source) of the driving transistor DT and its threshold voltage Vth. Therefore, the driving current of the light-emitting element $$Ioled \propto (Vgs - Vth)^2 = (Vg - Vs - Vth)^2 = \left(\left(Vth + \frac{C1}{C1 + C2}(Vdata - Vref) + PVEE + Voled\right) - (PVEE + Voled) - Vth\right)^2 = \left(\frac{C1}{C1 + C2}(Vdata - Vref)\right)^2.$$

It can be seen that the driving current Ioled of the light-emitting element EL is irrelevant to the threshold voltage Vth of the driving transistor DT, and compensation for the threshold voltage of the driving transistor DT is implemented.

Therefore, when the organic light-emitting pixel driving circuit of the present embodiment is applied to the organic light-emitting display panel, since the light-emitting electrical current is irrelevant to the threshold voltage Vth of the driving transistor DT, phenomena such as uneven display will not occur from the threshold difference of driving transistors, and display uniformity of the light-emitting display panel is improved.

Figure 3A:
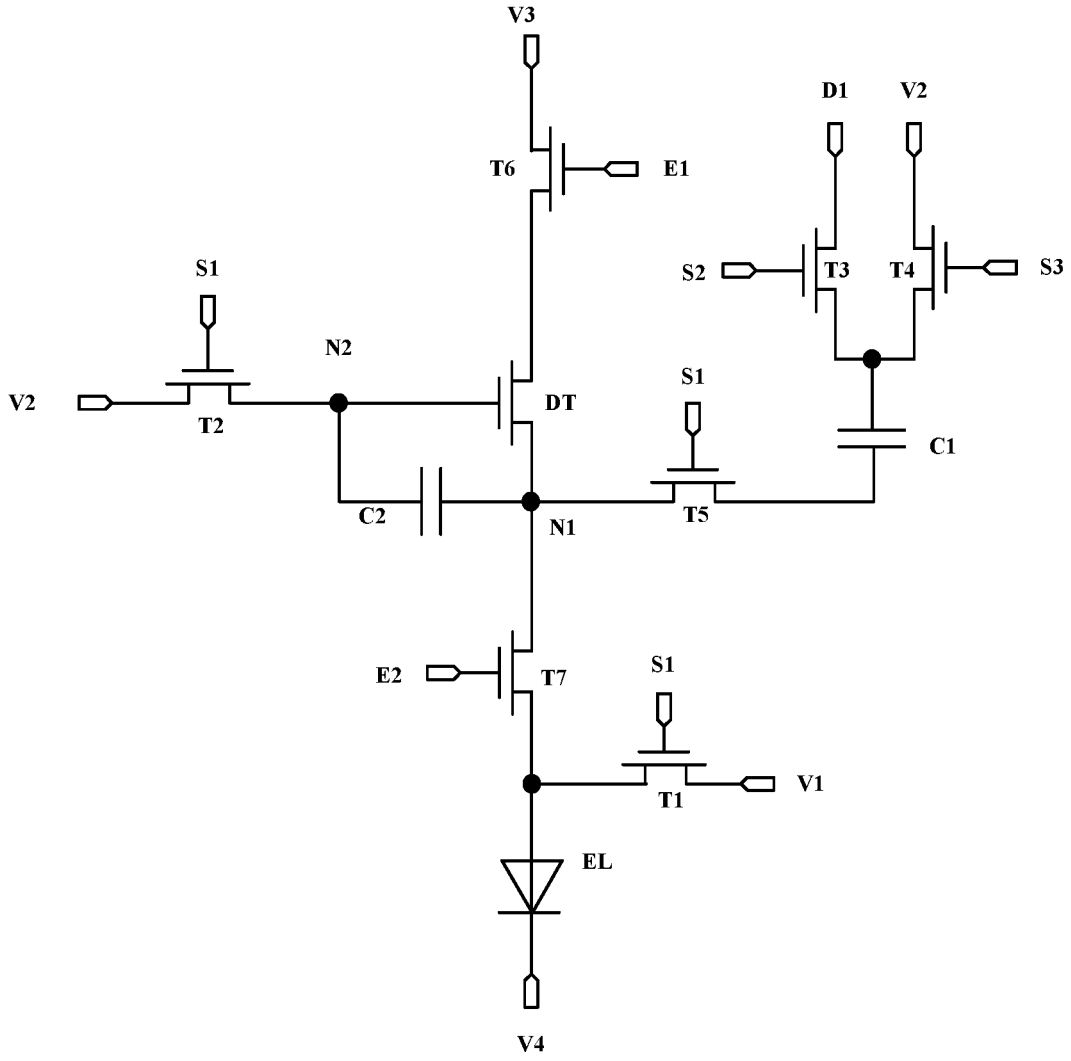
FIG. 3A illustrates a schematic diagram of an organic light-emitting pixel driving circuit according to a further embodiment of the present disclosure.

Then, reference is made to FIG. 3A which illustrates a schematic diagram of an organic light-emitting pixel driving circuit according to a further embodiment of the present disclosure.

Likewise, the organic light-emitting pixel driving circuit in the present embodiment also comprises a driving transistor DT, a light-emitting element EL, a first transistor T1, a second transistor T2, a third transistor T3, a fourth transistor T4, a fifth transistor T5, a sixth transistor T6, a first capacitor C1 and a second capacitor C2, as shown in FIG. 3A.

In the present embodiment, the organic light-emitting pixel driving circuit further comprises a first initialization signal line V1 and a data line D1. The driving transistor DT may generate a driving current enabling the light-emitting element EL to emit light so that the light-emitting element EL may emit light in response to the driving current. The first transistor T1 may transmit an initialization voltage on the first initialization signal line V1 to the light-emitting element EL in response to a signal input to a gate of the first transistor T1. The second transistor T2 transmits a second initialization voltage to the driving transistor DT in response to a signal input to a gate of the second transistor T2. The third transistor T3 may transmit a data signal voltage on the data line D1 to the organic light-emitting pixel driving circuit in response to the signal input to the gate of the third transistor T3. The fourth transistor T4 may transmit a reference voltage to the organic light-emitting pixel driving circuit in response to a signal input to a gate of the fourth transistor T4, wherein an output terminal of the third transistor T3 and an output terminal of the fourth transistor T4 may be electrically connected with each other.

In the present embodiment, the first capacitor C1 may be coupled in series between the output terminal of the third transistor T3 and the driving transistor DT. The fifth transistor T5 is electrically connected between the driving transistor DT and the first capacitor C1, and the fifth transistor T5 may control the first capacitor C1 to couple its own charge to the driving transistor DT in response to a signal input to the gate of the fifth transistor T5. The sixth transistor T6 may control light emission of the light-emitting element EL in response to a signal input to a gate of the sixth transistor T6. The second capacitor C2 may be coupled in series between the gate and source of the driving transistor DT, and may maintain amount of charge between the gate and source of the driving transistor DT unchanged.

It needs to be appreciated that the organic light-emitting pixel driving circuit in the present embodiment may further comprise a seventh transistor T7, as shown in FIG. 3A, wherein the seventh transistor T7 is coupled in series between the source of the driving transistor DT and the anode of the light-emitting element EL, and may, in response to the signal of the second light emission controlling signal line E2, control the electrical connection between the source of the driving transistor DT and the anode of the light-emitting element EL.

The organic light-emitting pixel driving circuit may further comprise a reference voltage line V2, a first scanning signal line S1, a second scanning signal line S2, a third scanning signal line S3, a first light emission controlling signal line E1, a second light emission controlling signal line E2 and a second power supply voltage signal line V4, as shown in FIG. 3A, wherein the reference voltage line V2 may output the reference voltage. A first electrode of the first transistor T1 is electrically connected with the first initialization signal line V1, a second electrode of the first transistor T1 is electrically connected with an anode of the light-emitting element EL, and a gate of the first transistor T1 is electrically connected with the first scanning signal line S1. A first electrode of the second transistor T2 is electrically connected with the reference voltage line V2, a second electrode of the second transistor T2 is electrically connected with the gate of the driving transistor DT, and a gate of the second transistor T2 is electrically connected with the first scanning signal line S1. A first electrode of the third transistor T3 is electrically connected with the data line D1, a second electrode of the third transistor T3 is electrically connected with a first electrode of the first capacitor C1, and a gate of the third transistor T3 is electrically connected with the second scanning signal line S2. A first electrode of the fourth transistor T4 is electrically connected with the reference voltage line V2, a second electrode of the fourth transistor T4 is electrically connected with the first electrode of the first capacitor C1, and a gate of the fourth transistor T4 is electrically connected with the third scanning signal line S3. A first electrode of the fifth transistor T5 is electrically connected with the second electrode of the first capacitor C1, a second electrode of the fifth transistor T5 is electrically connected with the source of the driving transistor DT, and a gate of the fifth transistor T5 is electrically connected with the first scanning signal line S1. A first electrode of the sixth transistor T6 is electrically connected with the first power supply voltage signal line V3, a second electrode of the sixth transistor T6 is electrically connected with a drain of the driving transistor DT, and a gate of the sixth transistor T6 is electrically connected with the light emission controlling signal line E1. A first electrode of the seventh transistor T7 is electrically connected with the source of the driving transistor DT, a second electrode of the seventh transistor T7 is electrically connected with an anode of the light-emitting element EL, and a gate of the seventh transistor T7 is electrically connected with the second light emission controlling signal line E2. A first electrode of the second capacitor C2 is electrically connected with the gate of the driving transistor DT, and a second electrode of the second capacitor C2 is electrically connected with the source of the driving transistor DT. A cathode of the light-emitting element EL is electrically connected with the second power supply voltage signal line V4, as shown in FIG. 3A.

Figure 3B:
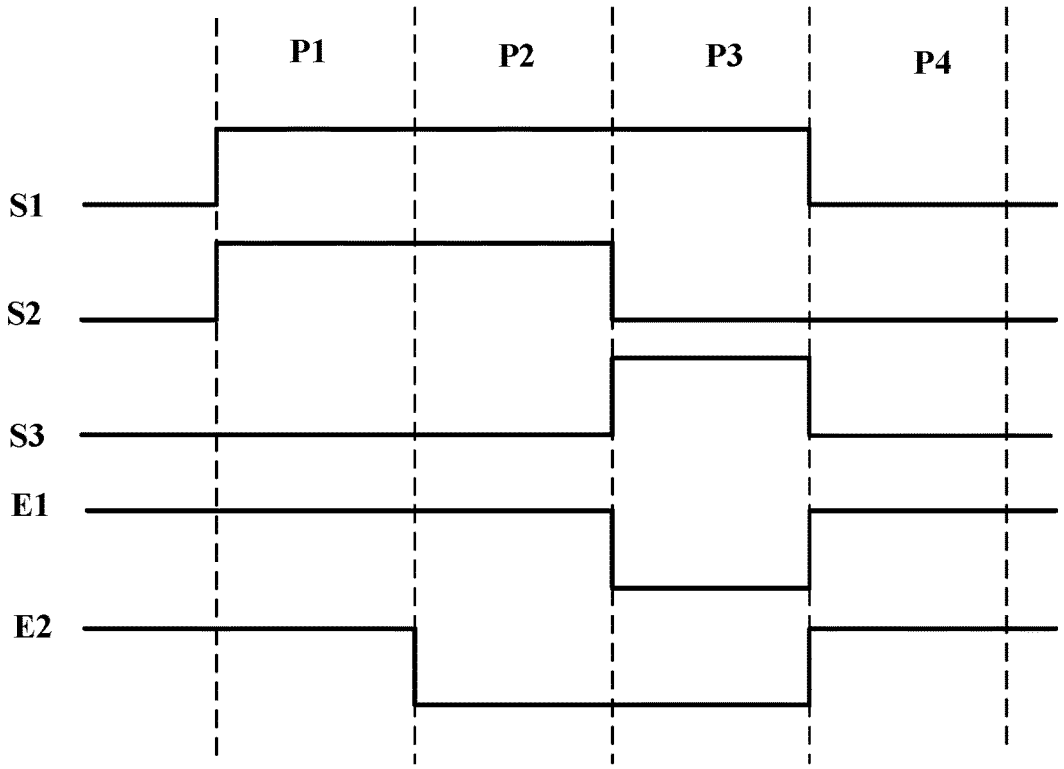
FIG. 3B illustrates a time sequence diagram of the organic light-emitting pixel driving circuit shown in FIG. 3A.

Likewise, the first transistor T1, second transistor T2, third transistor T3, fourth transistor T4, fifth transistor T5, sixth transistor T6, seventh transistor T7 and the driving transistor DT each may be an NMOS transistor, as shown in FIG. 3A. Hereunder, the working principle of the embodiment shown in FIG. 3A is described in conjunction with the time sequence diagram shown in FIG. 3B.

In a first phase P1, a high level signal is applied to the first scanning signal line S1, the second scanning signal line S2, the first light emission controlling signal line E1 and the second light emission controlling signal line E2, a low level signal is applied to the third scanning signal line S3, a first initialization voltage Vinit is applied to the first initialization voltage signal line V1, a reference voltage Vref is applied to the reference voltage line V2, and a data signal voltage Vdata is applied to the data line D1. The first transistor T1, second transistor T2, fourth transistor T3, fifth transistor T5 and sixth transistor T6 are turned on. The first transistor T1 outputs the first initialization voltage Vinit on the first initialization signal line V1 to a node of the light-emitting element EL and completes initialization of the light-emitting element EL. Furthermore, since the seventh transistor T7 is turned on, and the potential of node N1 (node N1 is an intersection point of the source of the driving transistor DT, the second electrode of the second capacitor C2, the first electrode of the seventh transistor T7, and the second electrode of the fifth transistor T5) is also the first initialization voltage Vinit. The second transistor T2 outputs the reference voltage Vref on the reference voltage line V2 to a node N2 (node N2 is an intersection point of the second electrode of the second transistor T2, the first electrode of the capacitor C2 and the gate of the driving transistor DT) so that the potential of the gate of the driving transistor DT is the reference voltage Vref and completes the initialization of the driving transistor DT. Meanwhile, the third transistor T3 outputs the data signal voltage Vdata on the data line D1 to the the first capacitor C1.

In a second phase P2, a high level signal is applied to the first scanning signal line S1, the second scanning signal line S2, the third scanning signal line S3 and the first light emission controlling signal line E1, a low level signal is applied to the second light emission controlling signal line E2, a data signal voltage Vdata is applied to the data line D1, the first initialization voltage Vinit is applied to the first initialization voltage signal line V1, and the reference voltage Vref is applied to the reference voltage line V2. The first transistor T1, second transistor T2, third transistor T3, fifth transistor T5 and sixth transistor T6 are turned on. The first transistor T1 continues to output the first initialization voltage Vinit on the first initialization voltage signal line V1 to the anode of the light-emitting element EL so that the potential of the anode of the light-emitting element EL remains unchanged. The second transistor T2 may output the reference voltage Vref on the reference voltage line V2 to the gate of the driving transistor DT so that the potential Vg of the gate of the driving transistor DT is Vref. The power supply voltage signal line V3 outputs the first power supply voltage to the driving transistor DT, the driving transistor DT is turned on, the potential Vs of the source of the driving transistor DT falls from Vinit to Vref-Vth, and the driving transistor DT is turned off. The potential of the second electrode of the first capacitor C1 is also Vref-Vth, so a voltage difference between two terminals of the first capacitor C1 is Vdata-Vref+Vth. When the second phase P2 ends, the potential difference of both terminals of the second capacitor C2 is Vth.

In a third phase P3, a high level signal is applied to the first scanning signal line S1 and the third scanning signal line S3, a low level signal is applied to the second scanning signal line S2, the first light emission controlling signal line E1 and the second light emission controlling signal line E2, a reference voltage Vref is applied to the reference voltage line V2, and the first initialization voltage Vinit is applied to the first initialization voltage signal line V1. The first transistor T1, second transistor T2, fourth transistor T4 and fifth transistor T5 are turned on. The reference voltage line V2 outputs the reference voltage Vref to the first electrode of the first capacitor C1 through the fourth transistor T4, and the reference voltage line V2 outputs the reference voltage Vref to the node N2 through the second transistor T2. The fifth transistor T5 is turned on, and the second electrode of the first capacitor C1 and the first electrode of the second capacitor C2 have the same potential which may be set as Z here. Hence, in the third phase P3, a total amount of charge of the first capacitor C1 and second capacitor C2 is (Vref−Z)×C2+(Vref−Z)×C1. In the second phase P2 and third phase P3, since the total amount of charge of the first capacitor C1 and second capacitor C2 does not change, and the total amount of charge of the first capacitor C1 and second capacitor C2 is (Vdata−Vref+Vth)×C1+Vth×C2 when the second phase P2 ends, the potential Z is $$Vref - Vth + \frac{C1}{C1 + C2}(Vref - Vdata)$$

in the third phase P3, namely, the potential of the source of the driving transistor DT is $$Vref - Vth + \frac{C1}{C1 + C2}(Vref - Vdata).$$

In a fourth phase P4, a high level signal is applied to the first light emission controlling signal line E1 and the second light emission controlling signal line E2, a low level signal is applied to the first scanning signal line S1, the second scanning signal line S2 and the third scanning signal line S3, and the sixth transistor T6 and seventh transistor T7 are turned on. The second power supply voltage signal line V4 outputs the second power supply voltage PVEE, the first power supply voltage signal line V3 provides the first power supply voltage to the driving transistor DT through the sixth transistor T6, the potential Vs of the source of the driving transistor DT changes from $$Vref - Vth + \frac{C1}{C1 + C2}(Vref - Vdata)$$

to PVEE+Voled, the light-emitting element EL emits light, whereupon the voltage difference between two terminals of the second capacitor C2 remains unchanged, and potential Vg of the gate of the driving transistor DT is $$Vth + \frac{C1}{C1 + C2}(Vdata - Vref) + PVEE + Voled.$$

Then, according to a formula of the light-emitting element generating the driving current, the driving current Ioled which flows through the driving transistor DT and is used to drive the light-emitting element EL to emit light will be in direct proportion to square of a differential value between a gate-source voltage Vgs (a voltage between the gate and source) of the driving transistor DT and its threshold voltage Vth. Therefore, the driving current of the light-emitting element $$EL\ Ioled \propto (Vgs - Vth)^2 = (Vg - Vs - Vth)^2 = \left(\left(Vth + \frac{C1}{C1 + C2}(Vdata - Vref) + PVEE + Voled\right) - (PVEE + Voled) - Vth\right)^2 = \left(\frac{C1}{C1 + C2}(Vdata - Vref)\right)^2.$$

It can be seen that the driving current Ioled of the light-emitting element EL is irrelevant to the threshold voltage Vth of the driving transistor DT, and compensation for the threshold voltage of the driving transistor DT is implemented.

It can be seen that when the organic light-emitting pixel driving circuit of the present embodiment is applied to the organic light-emitting display panel, since the light-emitting electrical current is irrelevant to the threshold voltage Vth of the driving transistor DT, phenomena such as uneven display will not occur from the threshold difference of driving transistors, and display uniformity of the light-emitting display panel is improved. Furthermore, as compared with the embodiment of FIG. 2A, the seventh transistor T7 is added so that the driving circuit may always reset the anode of the light-emitting element EL in the first phase P1, second phase P2 and third phase P3, and ensure that the light-emitting element EL does not emit light in the first phase P1, second phase P2 and third phase P3.

Figure 4:
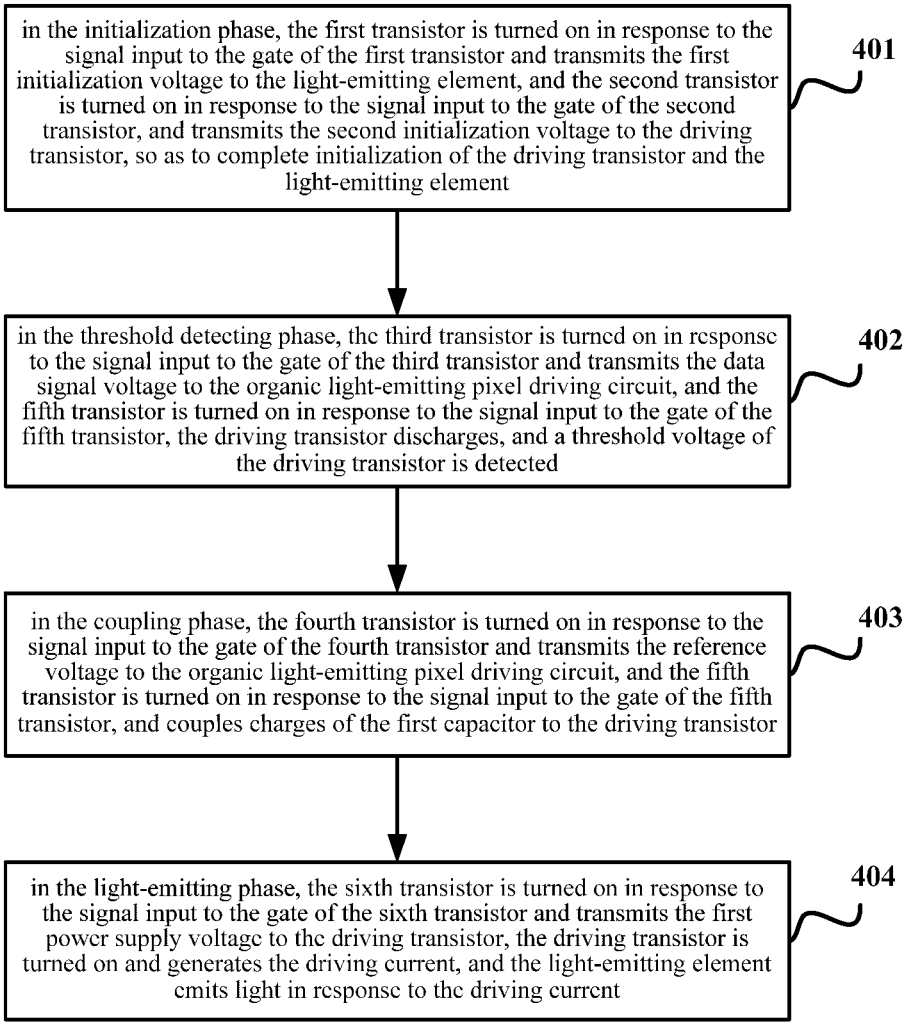
FIG. 4 illustrates a flow chart of a method of driving the organic light-emitting pixel driving circuit shown in FIG. 1A, FIG. 2A or FIG. 3A.

Then reference is made to FIG. 4 which illustrates a flow chart of a method of driving the organic light-emitting pixel driving circuit according to the present disclosure within one frame period. It needs to be appreciated that the method of driving the organic light-emitting pixel driving circuit in the present embodiment may be applied to drive the organic light-emitting pixel driving circuit as shown in FIG. 1A, FIG. 2A or FIG. 3A. As shown in the figure, the method of driving the organic light-emitting pixel driving circuit specifically comprises the following steps:

Step 401: in an initialization phase, the first transistor is turned on in response to the signal input to the gate of the first transistor and transmits the first initialization voltage to the light-emitting element, the second transistor is turned on in response to the signal input to the gate of the second transistor, transmits the second initialization voltage to the driving transistor, and completes initialization of the driving transistor and the light-emitting element.

Step 402: in a threshold detecting phase, the third transistor is turned on in response to the signal input to the gate of the third transistor and transmits the data signal voltage to the organic light-emitting pixel driving circuit, and the fifth transistor is turned on in response to the signal input to the gate of the fifth transistor, drives the transistor to discharge and detect the threshold voltage of the driving transistor.

Step 403: in a coupling phase, the fourth transistor is turned on in response to the signal input to the gate of the fourth transistor and transmits the reference voltage to the organic light-emitting pixel driving circuit, and the fifth transistor is turned on in response to the signal input to the gate of the fifth transistor, couples the charge of the first capacitor to the driving transistor.

Step 404: in a light-emitting phase, the sixth transistor is turned on in response to the signal input to the gate of the sixth transistor and transmits the first power supply voltage to the driving transistor, the driving transistor is turned on and generates the driving current, and the light-emitting element emits light in response to the driving current.

In the present embodiment, the driving method may be used to drive the organic light-emitting pixel driving circuit as shown in FIG. 1A. At this time, the capacitor C1 in the driving circuit is coupled in series to the gate of the driving transistor DT and the output terminal of the third transistor T3. In the coupling phase of the driving method, the fourth transistor T4 is turned on in response to the signal input to the gate of the fourth transistor T4 and transmits the reference voltage to the organic light-emitting pixel driving circuit, and the fifth transistor T5 is turned on in response to the signal input to the gate of the fifth transistor T5 and couples the charge of the first capacitor C1 to the gate of the driving transistor DT.

Specifically, the driving circuit shown in FIG. 1A may further comprise a reference voltage line V2, a first scanning signal line S1, a second scanning signal line S2, a first light emission controlling signal line E1, a second light emission controlling signal line E2 and a second power supply voltage signal line, and the reference voltage line V2 outputs the reference voltage. The gate of the first transistor T1 and the gate of the fifth transistor T5*i* in the driving circuit are electrically connected with the first scanning signal line S1, the gate of the second transistor T2 and the gate of the third transistor T3 are electrically connected with the second scanning signal line S2, the gate of the fourth transistor T4 is electrically connected with the first light emission controlling signal line E1, the gate of the sixth transistor T6 is electrically connected with the second light emission controlling signal line E2, and the second initialization voltage is the first power supply voltage output by the first power supply voltage signal line V3. The method of driving the organic light-emitting pixel driving circuit specifically comprises the following steps:

In the initialization phase, the first transistor T1 is turned on in response to the signal of the first scanning signal line S1 and transmits the first initialization voltage on the first initialization signal line V1 to the light-emitting element EL, and the second transistor T2 is turned on in response to the signal of the second scanning signal line S2, outputs the first power supply voltage to the driving transistor DT and completes initialization of the driving transistor DT and the light-emitting element EL.

In the threshold detecting phase, the second transistor T2 is turned on in response to the second scanning signal line S2, the third transistor T3 is turned on in response to the second scanning signal line S2, the data signal line D1 transmits the data signal voltage to the organic light-emitting pixel driving circuit, the fifth transistor T5 is turned on in response to the first scanning signal line S1, thereby turning on the driving transistor DT and discharging to the source of the driving transistor DT, and completing the detection of the threshold voltage of the driving transistor DT.

In the coupling phase, the fourth transistor T4 is turned on in response to the signal of the first light emission controlling signal line E1 and transmits the reference voltage to the organic light-emitting pixel driving circuit, and the fifth transistor T5 is turned on in response to the signal of the first scanning signal line S1 and couples the data signal voltage and the reference voltage stored by the first capacitor C1 to the gate of the driving transistor DT.

In the light-emitting phase, the sixth transistor T6 is turned on in response to the signal of the second light emission controlling signal line E2 and transmits the first power supply voltage to the driving transistor DT, the driving transistor DT is turned on and generates the driving current, and the light-emitting element EL emits light in response to the driving current.

Optionally, a voltage value of the data signal voltage may be smaller than a voltage value of the reference voltage. The first initialization signal line V1 may be multiplexed as the reference voltage line V2. At this time, the reference voltage is the first initialization voltage output by the first initialization signal line V1.

In the present embodiment, the method of driving the organic light-emitting pixel driving circuit may be used to drive the driving circuit as shown in FIG. 2A. The capacitor C1 in the driving circuit is coupled in series to the source of the driving transistor DT and the output terminal of the third transistor T3. In the coupling phase of the driving method, the fourth transistor T4 is turned on in response to the signal input to the gate of the fourth transistor and transmits the reference voltage to the organic light-emitting pixel driving circuit, and the fifth transistor T5 couples the charge of the first capacitor C1 to the source of the driving transistor DT in response to the signal input to the gate of the fifth transistor T5.

Specifically, the driving circuit shown in FIG. 2A may further comprise a reference voltage line V2, a first power supply voltage signal line V3, a first scanning signal line S1, a second scanning signal line S2, a third scanning signal line S3, a first light emission controlling signal line E1 and a second light emission controlling signal line E2, wherein the reference voltage line V2 outputs the reference voltage. The gate of the first transistor T1 in the driving circuit is electrically connected with the second scanning signal line S2, the gate of the second transistor T2 and gate of the fifth transistor T5 are electrically connected with the first scanning signal line S1, the gate of the third transistor T3 is electrically connected with the third scanning signal line S3, the gate of the fourth transistor T4 is electrically connected with the first light emission controlling signal line E1, the gate of the sixth transistor T6 is electrically connected with the second light emission controlling signal line E2, and the second initialization voltage is the reference voltage output by the reference voltage line V2. The method of driving the organic light-emitting pixel driving circuit specifically comprises the following steps:

In the initialization phase, the first transistor T1 is turned on in response to the signal of the second scanning signal line S2 and transmits the first initialization voltage to the light-emitting element EL, and the second transistor T2 is turned on in response to the signal of the first scanning signal line S1, outputs the reference voltage to the driving transistor DT and completes initialization of the driving transistor DT and the light-emitting element EL.

In the threshold detecting phase, the third transistor T3 is turned on in response to the signal of the third scanning signal line S3 and transmits the data signal voltage to the organic light-emitting pixel driving circuit, the second transistor T2 is turned on in response to the signal of the first scanning signal line S1 and transmits the reference voltage to the gate of the driving transistor DT, and the fifth transistor T5 is turned on in response to the signal of the first scanning signal line S1, the source of the driving transistor DT discharges to the first capacitor C1 and completes the detection of the threshold voltage of the driving transistor DT.

In the coupling phase, the fourth transistor T4 is turned on in response to the signal of the first light emission controlling signal line E1 and transmits the reference voltage to the organic light-emitting pixel driving circuit, and the fifth transistor T5 is turned on in response to the signal of the first scanning signal line S1 and couples the data signal voltage and the reference voltage stored by the first capacitor C1 to the source of the driving transistor DT. Furthermore, the voltage value of the data signal voltage is larger than the voltage value of the reference voltage.

In the light-emitting phase, the sixth transistor T6 is turned on in response to the signal of the second light emission controlling signal line E2 and transmits the first power supply voltage to the driving transistor DT, the driving transistor DT is turned on and generates the driving current, and the light-emitting element EL emits light in response to the driving current.

Optionally, the method of driving the organic light-emitting pixel driving circuit may be used to drive the organic light-emitting pixel driving circuit as shown in FIG. 3A. The driving circuit may further comprise: a reference voltage line V2, a first power supply voltage signal line V3, a first scanning signal line S1, a second scanning signal line S2, a third scanning signal line S3, a first light emission controlling signal line E1 and a second light emission controlling signal line E2, and a seventh transistor coupled in series between the driving transistor DT and the anode of light-emitting element EL, wherein the reference voltage line V2 outputs the reference voltage. The gate of the first transistor T1, the gate of the second transistor T2 and the gate of the fifth transistor T5 in the driving circuit are electrically connected with the first scanning signal line S1, the gate of the third transistor T3 is electrically connected with the second scanning signal line S2, the gate of the fourth transistor T4 is electrically connected with the third scanning signal line S3, the gate of the sixth transistor T6 is electrically connected with the first light emission controlling signal line E1, the gate of the seventh transistor T7 is electrically connected with the second light emission controlling signal line E2, and the second initialization voltage is the reference voltage output by the reference voltage line V2. The method of driving the organic light-emitting pixel driving circuit specifically comprises the following steps:

In the initialization phase, the first transistor T1 is turned on in response to the signal of the first scanning signal line S1 and transmits the first initialization voltage to the light-emitting element EL, and the second transistor T2 is turned on in response to the signal of the first scanning signal line S1, outputs the reference voltage to the driving transistor DT and completes initialization of the driving transistor DT and the light-emitting element EL.

In the threshold detecting phase, the third transistor T3 is turned on in response to the signal of the second scanning signal line S2 and transmits the data signal voltage to the organic light-emitting pixel driving circuit, the second transistor T2 is turned on in response to the signal of the first scanning signal line S1 and transmits the reference voltage to the gate of the driving transistor DT, and the fifth transistor T5 is turned on in response to the signal of the first scanning signal line S1, the source of the driving transistor DT discharges to the first capacitor C1 and completes the detection of the threshold voltage of the driving transistor DT.

In the coupling phase, the fourth transistor T4 is turned on in response to the signal of the third scanning signal line S3 and transmits the reference voltage to the organic light-emitting pixel driving circuit, and the fifth transistor T5 is turned on in response to the signal of the first scanning signal line S1 and couples the data signal voltage and the reference voltage stored by the first capacitor C1 to the source of the driving transistor DT.

In the light-emitting phase, the sixth transistor T6 is turned on in response to the signal of the first light emission controlling signal line E1 and transmits the first power supply voltage to the driving transistor DT, the driving transistor DT is turned on and generates the driving current, the seventh transistor T7 controls electrical connection between the drain of the driving transistor DT and anode of the light-emitting element EL in response to the signal of the second light emission controlling signal line E2, and the light-emitting element EL emits light in response to the driving current.

It needs to be appreciated that when the method of driving the organic light-emitting pixel driving circuit is used to drive the driving circuit shown in FIG. 3A, in the threshold detecting phase and coupling phase, the seventh transistor T7 is turned off in response to the signal of the second light emission controlling signal line E2, and ensures that the light-emitting element EL does not emit light in the threshold detecting phase and coupling phase.

Figure 5:
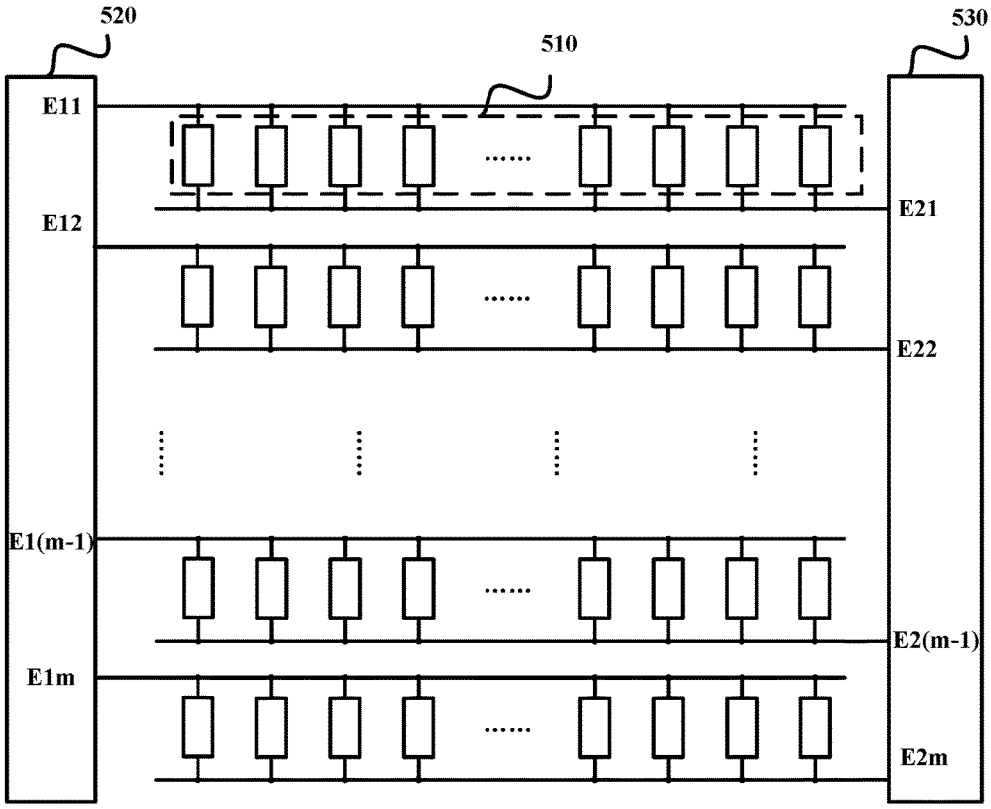
FIG. 5 illustrates a schematic diagram of an organic light-emitting display panel according to an embodiment of the present disclosure.

Reference is made to FIG. 5 which illustrates a schematic diagram of an organic light-emitting display panel according to an embodiment of the present disclosure.

The organic light-emitting display panel shown in FIG. 5 comprises multiple rows of pixel units 510, each row of pixel units 510 comprising a plurality of organic light-emitting pixel driving circuits. Each pixel unit in each row of pixel units 510 in the organic light-emitting display panel includes one organic light-emitting pixel driving circuit.

In the present embodiment, the organic light-emitting pixel driving circuit may be as shown in FIG. 1A, FIG. 2A or FIG. 3A, each row of pixel units are connected with the first light emission controlling signal line E and the second light emission controlling signal line E2. For example, in some application scenarios, the first light emission controlling signal lines E11-E1*m* and second light emission controlling signal lines E21-E2*m* may be generated by light emission controllers 520 and 530. In some application scenarios, the first light emission controlling signal lines E11-E1*m* may have the same waveform as E1 in FIG. 1B, and the second light emission controlling signal lines E21-E2*m* may have the same waveform as E2 in FIG. 1B. Alternatively, the organic light-emitting pixel driving circuit may be as shown in FIG. 2A, whereupon the first light emission controlling signal lines E11-E1*m* may have the same waveform as E1 in FIG. 1B, and the second light emission controlling signal lines E21-E2*m* may have the same waveform as E2 in FIG. 2B. Alternatively, the organic light-emitting pixel driving circuit may be as shown in FIG. 3A, whereupon the first light emission controlling signals E11-E1*m* may have the same waveform as E1 in FIG. 3B, and the second light emission controlling signals E21-E2*m* may have the same waveform as E2 in FIG. 3B.

As employing the above-mentioned organic light-emitting pixel driving circuit, the organic light-emitting display panel in the present embodiment may implement compensation for the threshold voltage of the driving transistor, and improve uniformity of luminance of the organic light-emitting display panel of the present embodiment. In addition, the organic light-emitting pixel driving circuit further solves the problem of voltage attenuation existing with the first power supply voltage of pixel units in different rows in the display panel.

Figure 6:
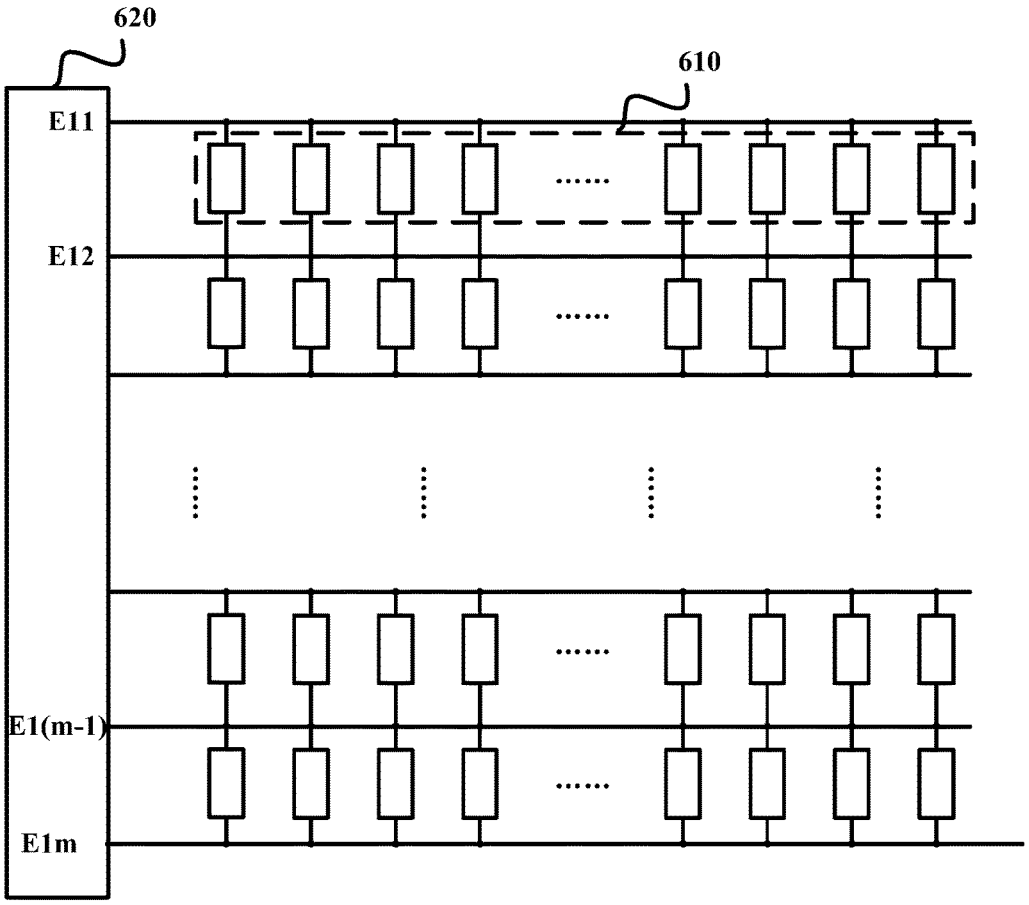
FIG. 6 illustrates a schematic diagram of an organic light-emitting display panel according to another embodiment of the present disclosure.

Referring to FIG. 6, FIG. 6 illustrates schematic structural diagram of an organic light-emitting display panel according to another embodiment of the present disclosure.

The organic light-emitting display panel in the present embodiment also comprise multiple rows of pixel units 610, each row of pixel units 610 comprising a plurality of organic light-emitting pixel driving circuits stated in the embodiments of the present disclosure. For example, each pixel unit in each row of pixel units 610 includes an organic light-emitting pixel driving circuit as shown in FIG. 1A or FIG. 2A. In addition, each row of pixel units are connected with a first light emission controlling signal line and a second light emission controlling signal line.

In the present embodiment, the organic light-emitting pixel driving circuit included by the organic light-emitting display panel is as shown in FIG. 1A. As shown in FIG. 1A, the organic light-emitting pixel driving circuit may further comprise a reference voltage line, a first power supply voltage signal, a first scanning signal line, a second scanning signal line, a first light emission controlling signal line and a second light emission controlling signal line, wherein the reference voltage line outputs the reference voltage. The gate of the first transistor and the gate of the fifth transistor are electrically connected with the first scanning signal line, the gate of the second transistor and gate of the third transistor are electrically connected with the second scanning signal line, the gate of the fourth transistor is electrically connected with the first light emission controlling signal line, the gate of the sixth transistor is electrically connected with the second light emission controlling signal line, and the second initialization voltage is the first power supply voltage output by the first power supply voltage signal line. The organic light-emitting pixel driving circuit may be driven by employing the time sequence shown in FIG. 1B. As can be seen in FIG. 1B, in the organic light-emitting display panel, the second light emission controlling signal line connected with the $i^{th}$ row of pixel units may be multiplexed as the first light emission controlling signal line of the $i+1^{th}$ row of pixel units, i being a positive integer.

Figure 2B:
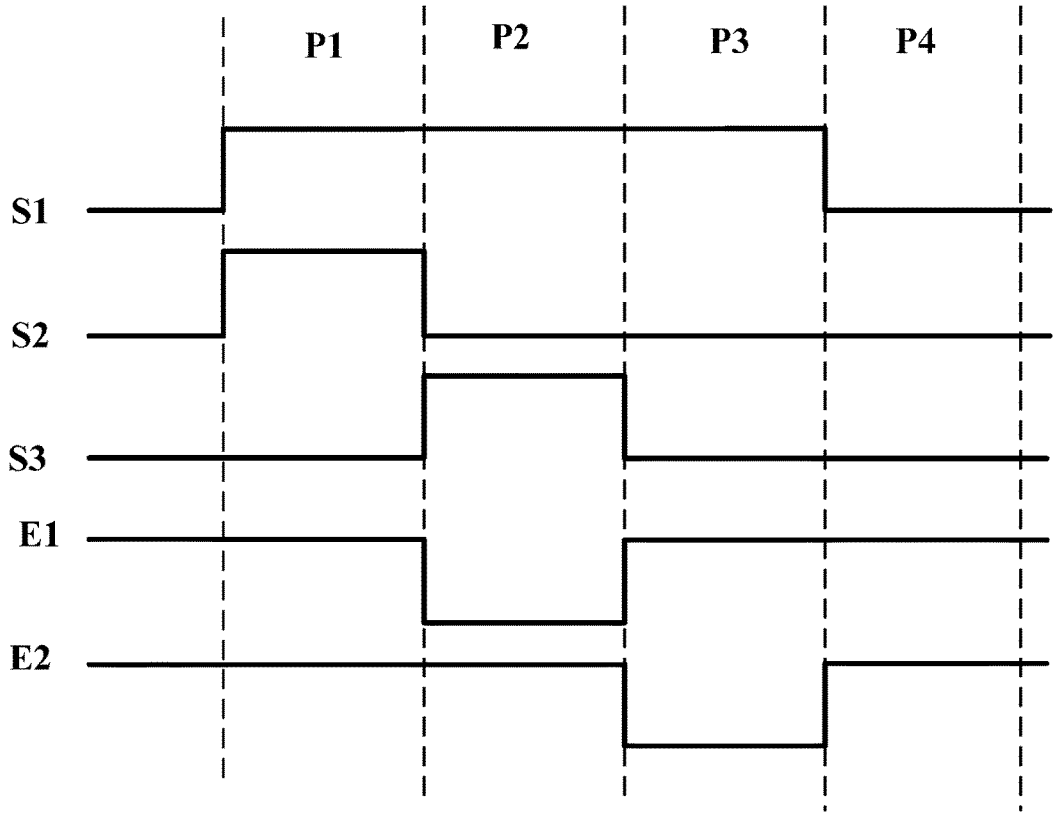
FIG. 2B illustrates a time sequence diagram of the organic light-emitting pixel driving circuit shown in FIG. 2A.

Alternatively, the organic light-emitting pixel driving circuit included by the organic light-emitting display panel is as shown in FIG. 2A. As shown in FIG. 2A, the organic light-emitting pixel driving circuit may further comprise a reference voltage line, a first power supply voltage signal line, a first scanning signal line, a second scanning signal line, a third scanning signal line, a first light emission controlling signal line and a second light emission controlling signal line, wherein the reference voltage line outputs the reference voltage. The gate of the first transistor is electrically connected with the second scanning signal line, the gate of the second transistor and gate of the fifth transistor are electrically connected with the first scanning signal line, the gate of the third transistor is electrically connected with the third scanning signal line, the gate of the fourth transistor is electrically connected with the first light emission controlling signal line, the gate of the sixth transistor is electrically connected with the second light emission controlling signal line, and the second initialization voltage is the reference voltage output by the reference voltage line. The organic light-emitting pixel driving circuit may be driven by employing the time sequence shown in FIG. 2B. As can be seen in FIG. 2B, in the organic light-emitting display panel, the second light emission controlling signal line connected with the $i^{th}$ row of pixel units may be multiplexed as the first light emission controlling signal line of the $i+1^{th}$ row of pixel units, i being a positive integer.

Specifically, as shown in FIG. 5, the second light emission controlling signal line of the first row of pixels is multiplexed as the first light emission controlling signal line of the second row of pixels. As such, the first light emission controlling signal and second light emission controlling signal needed by the organic light-emitting pixel driving circuits may be generated by the same light emission controller 620, thereby further reducing the area of the layout occupied by the circuit in the organic light-emitting display panel.

What have been described above are only preferred embodiments of the present application and illustrations of the employed technical principles. Those skilled in the art should understand that the invention scope related to in the present application is not limited to technical solutions formed by specific combinations of the technical features above, which should also cover other technical solutions formed by any arbitrary combination of the technical features above or their equivalent features without departing from the inventive concept. For example, technical features formed by mutual substitution of the features above with technical features with similar functions disclosed in the present application (but not limited thereto).

What is claimed is:

1. An organic light-emitting pixel driving circuit, comprising:

a driving transistor and a light-emitting element, wherein the driving transistor is configured to generate a driving current enabling the light-emitting element to emit light, wherein the light-emitting element is configured to emit light in response to the driving current;

a first transistor configured to transmit a first initialization voltage on a first initialization signal line to the light-emitting element in response to a signal input to a gate of the first transistor;

a second transistor configured to transmit a second initialization voltage to the driving transistor in response to a signal input to a gate of the second transistor;

a third transistor configured to transmit a data signal voltage on a data signal line to the organic light-emitting pixel driving circuit in response to a signal input to a gate of the third transistor;

a fourth transistor configured to transmit a reference voltage to the organic light-emitting pixel driving circuit in response to a signal input to a gate of the fourth transistor, wherein an output terminal of the third transistor and an output terminal of the fourth transistor are connected with each other;

a first capacitor coupled in series between the output terminal of the third transistor and the driving transistor;

a fifth transistor disposed between the first capacitor and the driving transistor and configured to control the first capacitor to couple own charges of the first capacitor to the driving transistor in response to a signal input to a gate of the fifth transistor;

a sixth transistor configured to control a light emission process of the light-emitting element in response to a signal input to a gate of the sixth transistor; and a second capacitor coupled in series between a gate and source of the driving transistor, and configured to store an amount of charges between the gate and source of the driving transistor.

2. The organic light-emitting pixel driving circuit according to claim 1, further comprising a first power supply voltage signal line outputting a first power supply voltage, wherein the second initialization voltage equals to the output of the first power supply voltage from the first power supply voltage signal line.

3. The organic light-emitting pixel driving circuit according to claim 2, wherein the first capacitor is coupled in series between the output terminal of the third transistor and the gate of driving transistor.

4. The organic light-emitting pixel driving circuit according to claim 3, further comprising:

a reference voltage line, a first scanning signal line, a second scanning signal line, a first light emission controlling signal line, a second light emission controlling signal line and a second power supply voltage signal line, wherein the reference voltage line outputs a reference voltage;

wherein a first electrode of the first transistor is electrically connected with the first initialization signal line, a second electrode of the first transistor is electrically connected with an anode of the light-emitting element, and the gate of the first transistor is electrically connected with the first scanning signal line;

wherein a first electrode of the second transistor is electrically connected with a drain of the driving transistor, a second electrode of the second transistor is electrically connected with the gate of the driving transistor, and the gate of the second transistor is electrically connected with the second scanning signal line;

wherein a first electrode of the third transistor is electrically connected with the data line, a second electrode of the third transistor is electrically connected with a first electrode of the first capacitor, and the gate of the third transistor is electrically connected with the second scanning signal line;

wherein a first electrode of the fourth transistor is electrically connected with the reference voltage line, a second electrode of the fourth transistor is electrically connected with the first electrode of the first capacitor, and the gate of the fourth transistor is electrically connected with first light emission controlling signal line, wherein a first electrode of the fifth transistor is electrically connected with the second electrode of the first capacitor, a second electrode of the fifth transistor is electrically connected with the gate of the driving transistor, and the gate of the fifth transistor is electrically connected with the first scanning signal line;

wherein a first electrode of the sixth transistor is electrically connected with the first power supply voltage signal line, a second electrode of the sixth transistor is electrically connected with the drain of the driving transistor, and the gate of the sixth transistor is electrically connected with the second light emission controlling signal line;

wherein a first electrode of the second capacitor is electrically connected with the gate of the driving transistor, and a second electrode of the second capacitor is electrically connected with the source of the driving transistor; and wherein the anode of the light-emitting element is electrically connected with the source of the driving transistor, and a cathode of the light-emitting element is electrically connected with the second power supply voltage signal line.

5. The organic light-emitting pixel driving circuit according to claim 4, wherein the first initialization signal line is multiplexed as the reference voltage line, and the reference voltage is the first initialization voltage.

6. The organic light-emitting pixel driving circuit according to claim 1, wherein the reference voltage line outputs the reference voltage;

wherein the second initialization voltage provides the reference voltage output from the reference voltage line.

7. The organic light-emitting pixel driving circuit according to claim 6, wherein the first capacitor is coupled in series between the output terminal of the third transistor and the source of the driving transistor.

8. The organic light-emitting pixel driving circuit according to claim 7, further comprising: a reference voltage line, a first scanning signal line, a second scanning signal line, a third scanning signal line, a first light emission controlling signal line, a second light emission controlling signal line and a second power supply voltage signal line, wherein the reference voltage line outputs the reference voltage;

wherein a first electrode of the first transistor is electrically connected with the first initialization signal line, a second electrode of the first transistor is electrically connected with an anode of the light-emitting element, and the gate of the first transistor is electrically connected with the second scanning signal line;

wherein a first electrode of the second transistor is electrically connected with the reference voltage line, a second electrode of the second transistor is electrically connected with the gate of the driving transistor, and the gate of the second transistor is electrically connected with the first scanning signal line;

wherein a first electrode of the third transistor is electrically connected with the data line, a second electrode of the third transistor is electrically connected with a first electrode of the first capacitor, and the gate of the third transistor is electrically connected with the third scanning signal line;

wherein a first electrode of the fourth transistor is electrically connected with the reference voltage line, a second electrode of the fourth transistor is electrically connected with the first electrode of the first capacitor, and the gate of the fourth transistor is electrically connected with first light emission controlling signal line;

wherein a first electrode of the fifth transistor is electrically connected with the second electrode of the first capacitor, a second electrode of the fifth transistor is electrically connected with the source of the driving transistor, and the gate of the fifth transistor is electrically connected with the first scanning signal line;

wherein a first electrode of the sixth transistor is electrically connected with the first power supply voltage signal line, a second electrode of the sixth transistor is electrically connected with a drain of the driving transistor, and the gate of the sixth transistor is electrically connected with the second light emission controlling signal line;

wherein a first electrode of the second capacitor is electrically connected with the gate of the driving transistor, and a second electrode of the second capacitor is electrically connected with the source of the driving transistor;

wherein an anode of the light-emitting element is electrically connected with the source of the driving transistor, and a cathode of the light-emitting element is electrically connected with the second power supply voltage signal line.

9. The organic light-emitting pixel driving circuit according to claim 7, further comprising: a seventh transistor coupled in series between the driving transistor and the anode of the light-emitting element, and configured to control the electrical connection between the driving transistor and the anode of the light-emitting element in response to a signal of the second light emission controlling signal line.

10. The organic light-emitting pixel driving circuit according to claim 9, further comprising: a reference voltage line, a first scanning signal line, a second scanning signal line, a third scanning signal line, a first light emission controlling signal line, a second light emission controlling signal line and a second power supply voltage signal line, wherein the reference voltage line outputs the reference voltage;

wherein a first electrode of the first transistor is electrically connected with the first initialization signal line, a second electrode of the first transistor is electrically connected with an anode of the light-emitting element, and the gate of the first transistor is electrically connected with the first scanning signal line;

wherein a first electrode of the second transistor is electrically connected with the reference voltage line, a second electrode of the second transistor is electrically connected with the gate of the driving transistor, and the gate of the second transistor is electrically connected with the first scanning signal line;

wherein a first electrode of the third transistor is electrically connected with the data line, a second electrode of the third transistor is electrically connected with a first electrode of the first capacitor, and the gate of the third transistor is electrically connected with the second scanning signal line;

wherein a first electrode of the fourth transistor is electrically connected with the reference voltage line, a second electrode of the fourth transistor is electrically connected with the first electrode of the first capacitor, and the gate of the fourth transistor is electrically connected with the third scanning signal line;

wherein a first electrode of the fifth transistor is electrically connected with the second electrode of the first capacitor, a second electrode of the fifth transistor is electrically connected with the source of the driving transistor, and the gate of the fifth transistor is electrically connected with the first scanning signal line;

wherein a first electrode of the sixth transistor is electrically connected with the first power supply voltage signal line, a second electrode of the sixth transistor is electrically connected with a drain of the driving transistor, and the gate of the sixth transistor is electrically connected with the light emission controlling signal line;

wherein a first electrode of the seventh transistor is electrically connected with the source of the driving transistor, a second electrode of the seventh transistor is electrically connected with an anode of the light-emitting element, and a gate of the seventh transistor is electrically connected with the second light emission controlling signal line;

wherein a first electrode of the second capacitor is electrically connected with the gate of the driving transistor, and a second electrode of the second capacitor is electrically connected with the source of the driving transistor; and wherein a cathode of the light-emitting element is electrically connected with the second power supply voltage signal line.

11. A method of driving the organic light-emitting pixel driving circuit according to claim 1, comprising:

an initialization phase wherein the first transistor is turned on in response to the signal input to the gate of the first transistor and transmits the first initialization voltage to the light-emitting element, and the second transistor is turned on in response to the signal input to the gate of the second transistor, and transmits the second initialization voltage to the driving transistor, so as to complete initialization of the driving transistor and the light-emitting element;

a threshold detecting phase wherein the third transistor is turned on in response to the signal input to the gate of the third transistor and transmits the data signal voltage to the organic light-emitting pixel driving circuit, and the fifth transistor is turned on in response to the signal input to the gate of the fifth transistor, the driving transistor discharges, and a threshold voltage of the driving transistor is detected;

a coupling phase wherein the fourth transistor is turned on in response to the signal input to the gate of the fourth transistor and transmits the reference voltage to the organic light-emitting pixel driving circuit, and the fifth transistor is turned on in response to the signal input to the gate of the fifth transistor, and couples charges of the first capacitor to the driving transistor; and a light-emitting phase wherein the sixth transistor is turned on in response to the signal input to the gate of the sixth transistor and transmits the first power supply voltage to the driving transistor, the driving transistor is turned on and generates the driving current, and the light-emitting element emits light in response to the driving current.

12. The method according to claim 11, wherein in the coupling phase, the fourth transistor is turned on in response to the signal input to the gate of the fourth transistor and transmits the reference voltage to the organic light-emitting pixel driving circuit, and the fifth transistor is turned on in response to the signal input to the gate of the fifth transistor and couples charges of the first capacitor to the gate of the driving transistor.

13. The method according to claim 11, wherein the organic light-emitting pixel driving circuit further comprises: a reference voltage line, a first scanning signal line, a second scanning signal line, a first light emission controlling signal line and a second light emission controlling signal line, the reference voltage line outputs the reference voltage;

wherein the gate of the first transistor and the gate of the fifth transistor are electrically connected with the first scanning signal line, the gate of the second transistor and the gate of the third transistor are electrically connected with the second scanning signal line, the gate of the fourth transistor is electrically connected with the first light emission controlling signal line, the gate of the sixth transistor is electrically connected with the second light emission controlling signal line;

wherein the second initialization voltage is the first power supply voltage output from the first power supply voltage signal line; and wherein in the initialization phase, the first transistor is turned on in response to a signal from the first scanning signal line and transmits the first initialization voltage on the first initialization signal line to the light-emitting element, and the second transistor is turned on in response to a signal from the second scanning signal line and outputs the first power supply voltage to the driving transistor, so as to complete initialization of the driving transistor and the light-emitting element;

wherein in the threshold detecting phase, the second transistor is turned on in response to the second scanning signal, the third transistor is turned on in response to the second scanning signal, the data signal line transmits the data signal voltage to the organic light-emitting pixel driving circuit, the fifth transistor is turned on in response to the first scanning signal, so as to turn on the driving transistor, discharge to the source of the driving transistor, and complete detection of the threshold voltage of the driving transistor;

wherein in the coupling phase, the fourth transistor is turned on in response to a signal from the first light emission controlling signal line and transmits the reference voltage to the organic light-emitting pixel driving circuit, and the fifth transistor is turned on in response to a signal from the first scanning signal line and couples the data signal voltage and the reference voltage stored in the first capacitor to the gate of the driving transistor; and wherein in the light-emitting phase, the sixth transistor is turned on in response to a signal from the second light emission controlling signal line and transmits the first power supply voltage to the driving transistor, the driving transistor is turned on and generates the driving current, and the light-emitting element emits light in response to the driving current.

14. The method according to claim 13, wherein a voltage value of the data signal voltage is smaller than a voltage value of the reference voltage.

15. The method according to claim 14, wherein the first initialization signal line is multiplexed as the reference voltage line, and the reference voltage is the first initialization voltage.

16. The method according to claim 11, wherein in the coupling phase, the fourth transistor is turned on in response to the signal input to the gate of the fourth transistor and transmits the reference voltage to the organic light-emitting pixel driving circuit, and the fifth transistor is turned on in response to the signal input to the gate of the fifth transistor and couples charges of the first capacitor to the source of the driving transistor.

17. The method according to claim 16, wherein the organic light-emitting pixel driving circuit further comprises: a reference voltage line, a first power supply voltage signal line, a first scanning signal line, a second scanning signal line, a third scanning signal line, a first light emission controlling signal line and a second light emission controlling signal line, the reference voltage line outputs the reference voltage;

wherein the gate of the first transistor is electrically connected with the second scanning signal line, the gate of the second transistor and gate of the fifth transistor are electrically connected with the first scanning signal line, the gate of the third transistor is electrically connected with the third scanning signal line, the gate of the fourth transistor is electrically connected with the first light emission controlling signal line, the gate of the sixth transistor is electrically connected with the second light emission controlling signal line; and wherein the second initialization voltage is the reference voltage output from the reference voltage line;

wherein in the initialization phase, the first transistor is turned on in response to a signal from the second scanning signal line and transmits the first initialization voltage to the light-emitting element, and the second transistor is turned on in response to a signal from the first scanning signal line and outputs the reference voltage to the driving transistor, so as to complete initialization of the driving transistor and the light-emitting element;

wherein in the threshold detecting phase, the third transistor is turned on in response to a signal from the third scanning signal line and transmits the data signal voltage to the organic light-emitting pixel driving circuit, the second transistor is turned on in response to the first scanning signal and transmits the reference voltage to the gate of the driving transistor, and the fifth transistor is turned on in response to a signal from the first scanning signal line, and the source of the driving transistor discharges to the first capacitor, so as to complete detection of the threshold voltage of the driving transistor;

wherein in the coupling phase, the fourth transistor is turned on in response to a signal from the first light emission controlling signal line and transmits the reference voltage to the organic light-emitting pixel driving circuit, and the fifth transistor is turned on in response to a signal from the first scanning signal line and couples the data signal voltage and the reference voltage stored in the first capacitor to the source of the driving transistor; and wherein in the light-emitting phase, the sixth transistor is turned on in response to a signal from the second light emission controlling signal line and transmits the first power supply voltage to the driving transistor, the driving transistor is turned on and generates a driving current, and the light-emitting element emits light in response to the driving current.

18. The method according to claim 16, wherein the organic light-emitting pixel driving circuit further comprises: a reference voltage line, a first power supply voltage signal line, a first scanning signal line, a second scanning signal line, a third scanning signal line, a first light emission controlling signal line, a second light emission controlling signal line, and a seventh transistor coupled in series between the driving transistor and the anode of the light-emitting element;

wherein the reference voltage line outputs the reference voltage;

wherein the gate of the first transistor, the gate of the second transistor and the gate of the fifth transistor are electrically connected with the first scanning signal line, the gate of the third transistor is electrically connected with the second scanning signal line, the gate of the fourth transistor is electrically connected with the third scanning signal line, the gate of the sixth transistor is electrically connected with the first light emission controlling signal line, and the gate of the seventh transistor is electrically connected with the second light emission controlling signal line, wherein the second initialization voltage is the reference voltage output from the reference voltage line;

wherein in the initialization phase, the first transistor is turned on in response to a signal from the first scanning signal line and transmits the first initialization voltage to the light-emitting element, and the second transistor is turned on in response to a signal from the first scanning signal line and outputs the reference voltage to the driving transistor, so as to complete initialization of the driving transistor and the light-emitting element;

wherein in the threshold detecting phase, the third transistor is turned on in response to a signal from the second scanning signal line and transmits the data signal voltage to the organic light-emitting pixel driving circuit, the second transistor is turned on in response to the first scanning signal and transmits the reference voltage to the gate of the driving transistor, the fifth transistor is turned on in response to a signal from the first scanning signal line, and the source of the driving transistor discharges to the first capacitor, so as to complete detection of the threshold voltage of the driving transistor;

wherein in the coupling phase, the fourth transistor is turned on in response to a signal from the third scanning signal line and transmits the reference voltage to the organic light-emitting pixel driving circuit, and the fifth transistor is turned on in response to a signal from the first scanning signal line and couples the data signal voltage and the reference voltage stored in the first capacitor to the source of the driving transistor; and wherein in the light-emitting phase, the sixth transistor is turned on in response to a signal from the first light emission controlling signal line and transmits the first power supply voltage to the driving transistor, the driving transistor is turned on and generates a driving current, the seventh transistor controls electrical connection between the drain of the driving transistor and the anode of the light-emitting element in response to a signal from the second light emission controlling signal line, and the light-emitting element emits light in response to the driving current.

19. The method according to claim 18, wherein in the threshold detecting phase and coupling phase, the seventh transistor is turned off in response to a signal from the second light emission controlling signal line.

20. The method according to claim 16, wherein a voltage value of the data signal voltage is larger than a voltage value of the reference voltage.

21. An organic light-emitting display panel comprising multiple rows of pixel units, wherein each row of the pixel units comprise a plurality of organic light-emitting pixel driving circuits according to claim 1.

22. The organic light-emitting display panel according to claim 21, wherein the organic light-emitting pixel driving circuit comprises: a reference voltage line, a first power supply voltage signal line, a first scanning signal line, a second scanning signal line, a first light emission controlling signal line and a second light emission controlling signal line, the reference voltage line outputs the reference voltage;

wherein the gate of the first transistor and the gate of the fifth transistor are electrically connected with the first scanning signal line, the gate of the second transistor and gate of the third transistor are electrically connected with the second scanning signal line, the gate of the fourth transistor is electrically connected with the first light emission controlling signal line, and the gate of the sixth transistor is electrically connected with the second light emission controlling signal line;

wherein the second initialization voltage is the first power supply voltage output from the first power supply voltage signal line; and wherein each row of the pixel units are connected with the first light emission controlling signal line and the second light emission controlling signal line.

23. The organic light-emitting display panel according to claim 21, wherein the organic light-emitting pixel driving circuit further comprises: a reference voltage line, a first power supply voltage signal line, a first scanning signal line, a second scanning signal line, a third scanning signal line, a first light emission controlling signal line and a second light emission controlling signal line, the reference voltage line outputs the reference voltage;

wherein the gate of the first transistor is electrically connected with the second scanning signal line, the gate of the second transistor and the gate of the fifth transistor are electrically connected with the first scanning signal line, the gate of the third transistor is electrically connected with the third scanning signal line, the gate of the fourth transistor is electrically connected with the first light emission controlling signal line, and the gate of the sixth transistor is electrically connected with the second light emission controlling signal line;

wherein the second initialization voltage is the reference voltage output from the reference voltage line; and wherein each row of the pixel units are connected with the first light emission controlling signal line and the second light emission controlling signal line.

24. The organic light-emitting display panel according to claim 22, wherein the second light emission controlling signal line connected with an $i^{th}$ row of the pixel units is multiplexed as the first light emission controlling signal line of an $i+1^{th}$ row of pixel units, i being a positive integer.

* * * * *